US011645961B2

(12) United States Patent
Lee et al.

(10) Patent No.: US 11,645,961 B2
(45) Date of Patent: May 9, 2023

(54) METHOD FOR CONTROLLING SCALING OF DISPLAY, AND CIRCUIT AND ELECTRONIC DEVICE SUPPORTING THE SAME

(71) Applicant: Samsung Electronics Co., Ltd., Suwon-si (KR)

(72) Inventors: Taewoong Lee, Suwon-si (KR); Jongkon Bae, Suwon-si (KR); Jaesung Lee, Suwon-si (KR); Kyungtae Kim, Suwon-si (KR); Kwangtai Kim, Suwon-si (KR); Donghyun Yeom, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/557,573

(22) Filed: Dec. 21, 2021

(65) Prior Publication Data

US 2022/0319372 A1 Oct. 6, 2022

Related U.S. Application Data

(63) Continuation of application No. PCT/KR2021/017655, filed on Nov. 26, 2021.

(30) Foreign Application Priority Data

Apr. 5, 2021 (KR) ..... 10-2021-0044119

(51) Int. Cl.
*G09G 3/20* (2006.01)

(52) U.S. Cl.
CPC ..... *G09G 3/20* (2013.01); *G09G 2340/0407* (2013.01); *G09G 2360/12* (2013.01)

(58) Field of Classification Search
CPC ..... G09G 3/20; G09G 2340/0407; G09G 2360/12
See application file for complete search history.

(56) References Cited

U.S. PATENT DOCUMENTS 8,228,346 B1 7/2012 Pan et al.
8,319,800 B2 11/2012 Pan et al.
(Continued)

FOREIGN PATENT DOCUMENTS

JP 5473007 B2 4/2014
KR 10-0929681 B1 12/2009
(Continued)

OTHER PUBLICATIONS

International Search Report and Written Opinion of the International Searching Authority in connection with International Application No. PCT/KR2021/017655 dated Mar. 22, 2022, 10 pages.

*Primary Examiner* — Sejoon Ahn

(57) ABSTRACT

Disclosed is a display driver circuit including a resolution analyzer that detects a size of a portion of screen input data received from a processor, and acquires a setting related to scaling of the screen input data based on the detected size, and an image processor that generates screen output data corresponding to a resolution of the display panel based on the acquired setting, and supplies the generated screen output data to a display panel. Various embodiments identified herein may be realized.

15 Claims, 9 Drawing Sheets

(56) References Cited

U.S. PATENT DOCUMENTS

| | | | | |
|---|---|---|---|---|
| 9,131,098 | B2 | 9/2015 | Jang et al. | |
| 2012/0001914 | A1 | 1/2012 | Pan et al. | |
| 2014/0098289 | A1 | 4/2014 | Jang et al. | |
| 2020/0285475 | A1* | 9/2020 | Kwon | G06F 11/07 |
| 2020/0286415 | A1* | 9/2020 | Shi | G06F 3/1423 |

FOREIGN PATENT DOCUMENTS

| | | | |
|---|---|---|---|
| KR | 10-2010-0068625 | A | 6/2010 |
| KR | 10-1139680 | B1 | 4/2012 |
| KR | 10-2013-0018706 | A | 2/2013 |
| KR | 10-2014-0044235 | A | 4/2014 |

* cited by examiner

METHOD FOR CONTROLLING SCALING OF DISPLAY, AND CIRCUIT AND ELECTRONIC DEVICE SUPPORTING THE SAME

CROSS-REFERENCE TO RELATED APPLICATIONS

This application is a continuation of International Application No. PCT/KR2021/017655 filed on Nov. 26, 2021, which claims priority to Korean Patent Application No. 10-2021-0044119 filed on Apr. 5, 2021, the disclosures of which are herein incorporated by reference in their entirety.

BACKGROUND

1. Field

Various embodiments of the disclosure relate to a scaling function of a display.

2. Description of Related Art

An electronic device includes a display device for displaying information. Various contents may be displayed in a complex manner on the display device. Various contents may have various resolutions. In this regard, the display device provides a function to scale a resolution of input content based on a resolution of a display panel. For example, the scaling scheme scales screen input data of a resolution different from an output resolution of the display device to change a resolution of the screen input data to the output resolution.

Because data transmission and instruction transmission between a processor and a display driver circuit are not synchronized with each other, the data transmission and the instruction transmission must be distinguished from each other. In this system environment, when resolution change of screen input data is requested, transmission of various instructions related to scaling between the processor and the display driver circuit and application of settings based on the resolution change are executed. In this process, screen flickering or screen disconnection may occur.

Accordingly, various embodiments of the disclosure have a purpose to provide a method for controlling scaling of a display in which when a resolution of screen input data (or compressed screen data, screen data, input image) provided from a processor is changed (e.g., when update of a memory (e.g., GRAM) of a display driver circuit related to the resolution change occurs), the method analyzes a size or resolution of the screen input data based on a analyzing result of at least one portion of the screen input data, and then adjusts settings of at least some components of the display driver circuit based on the analyzed resolution to perform appropriate scaling, and to provide a circuit and an electronic device supporting the method.

Further, various embodiments of the disclosure have a purpose to provide a method for controlling scaling of a display in which in a scaler application structure, a processor does not transmit an instruction related to resolution change to a display driver circuit, and the display driver circuit adaptively changes and outputs a resolution of screen input data, and to provide a circuit and an electronic device supporting the method.

The technical purposes to be achieved in the disclosure are not limited to the technical purposes as mentioned above. Other technical purposes not mentioned may be obvious to those of ordinary skill in the art to which the disclosure belongs from following descriptions.

SUMMARY

A display driver circuit according to various embodiments may include a resolution analyzer that detects a size of a portion of screen input data received from a processor, and acquires a setting related to scaling of the screen input data based on the detected size, and an image processor that generates screen output data corresponding to a resolution of the display panel based on the acquired setting, and supplies the generated screen output data to a display panel.

A method for controlling scaling of a display according to one embodiment may include detecting, by a display driver circuit, a size of a portion of screen input data received from a processor, acquiring, by the display driver circuit, a setting related to scaling of the screen input data based on the detected size, generating, by the display driver circuit, screen output data corresponding to a resolution of the display panel, based on the acquired setting, and supplying, by the display driver circuit, the generated screen output data to the display panel.

An electronic device according to one embodiment may include a display panel, a display driver circuit for driving the display panel, and a processor for supplying screen input data to the display driver circuit, wherein the display driver circuit may include a resolution analyzer that detects a size of a portion of the screen input data received from the processor, and acquires a setting related to scaling of the screen input data based on the detected size, and an image processor that generates screen output data corresponding to a resolution of the display panel based on the acquired setting, and supplies the generated screen output data to the display panel.

According to various embodiments, the disclosure may support a seamless and continuous real-time resolution change function during image output from the display device.

Other effects of the disclosure may be set forth together with the detailed description of the disclosure.

Before undertaking the Mode for Invention below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
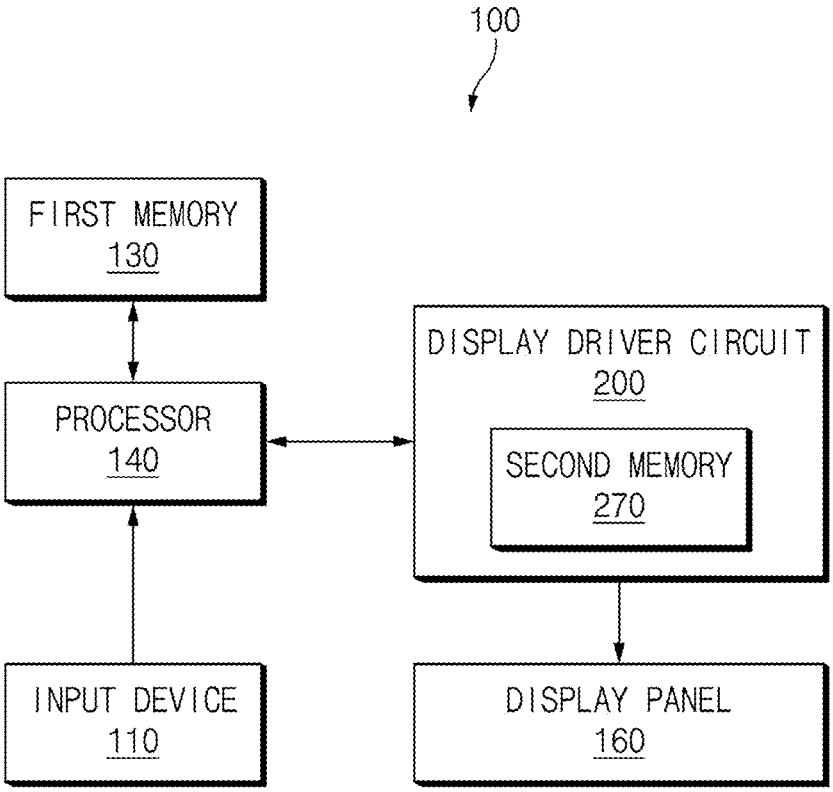
FIG. 1 is a diagram showing an example of a configuration of an electronic device according to one embodiment.

FIGS. 1 through 7, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter, various embodiments of this document are described with reference to the accompanying drawings. However, the disclosure is not limited to specific embodiments. The disclosure includes various modifications of, equivalents to, and/or alternatives to the embodiments. In connection with the description of the drawings, like reference numerals may be allocated to like components.

FIG. 1 is a diagram showing an example of an electronic device configuration according to one embodiment.

Referring to FIG. 1, an electronic device 100 according to one embodiment may include an input device 110, a first memory 130, a processor 140 (e.g., an application processor), and a display device (e.g., a display driver circuit 200 (a display driver IC (DDIC or DDI), and a display panel 160 (or display)). Further, the display driver circuit 200 may include a second memory 270. According to various embodiments, when the electronic device 100 supports a communication function, the electronic device 100 may further include at least one communication processor and at least one antenna related to communication function operation. The electronic device 100 may create a communication channel with a server or another external electronic device that provides content with a specific resolution based on the communication processor and the antenna, and may output the content with the specific resolution to the display panel 160.

The input device 110 may receive a user input and transmit the received user input to the processor 140. The input device 110 may include, for example, at least one of a touch screen, a physical button, a touch pad, an electronic pen, or a voice input (e.g., a microphone). The input device 110 may further include a camera, and the user may generate a user input by taking a designated gesture using the camera. According to one embodiment, the input device 110 may receive a user input related to resolution change of the display panel 160. In this regard, the display panel 160 may output a user interface (UI) related to the resolution change. According to one embodiment, the display panel 160 may output the user interface (UI) including an item that may select any one resolution among HD (High definition), FHD (Full-HD), QHD (Quad-HD), and WQHD (wide-QHD).

The input device 110 may include a touch screen that may change a resolution setting of an entire screen through the user interface. According to various embodiments, the input device 110 may include at least one microphone as a component thereof, and may receive a specified user utterance related to resolution setting change input through the at least one microphone. According to one embodiment, the input device 110 may further include at least one of an angle sensor (e.g., when the electronic device is a foldable electronic device, a sensor that may be used to detect an angle based on change in the resolution according to opening and closing; when the electronic device is a rollable electronic device, a sensor used to detect a size of a rolled area or an unrolled area of a wound display panel 160), a motion sensor, a biosensor, or an optical sensor. According to various embodiments, the input device 110 may include a sensor (e.g., at least one of a geomagnetic sensor and an acceleration sensor) to sense a state of the electronic device (e.g., when the electronic device is a foldable electronic device, a folded state or an unfolded state of the electronic device; when the electronic device is a rollable electronic device, a rolled state or an unrolled state by a specified size) to detect change in the resolution of the display corresponding to change of the state.

The first memory 130 may store therein at least one of various data, control commands, at least one instruction, and a program related to operation of the electronic device 100. For example, the first memory 130 may store therein an operating program related to the operation of the electronic device 100 and a program related to changing a resolution value of the display panel 160. According to various embodiments, the first memory 130 may store therein an image or a moving image having at least one resolution. An image or a moving image having a specific resolution stored in the first memory 130 may be transmitted to the display driver circuit 200 in response to control of the processor 140.

The processor 140 may be operatively connected with at least one of the input device 110, the first memory 130, the display panel 160 and the display driver circuit 200. According to one embodiment, the processor 140 and/or the display driver circuit 200 may control various interfaces. For example, the interface may include a mobile industry processor interface (MIPI), a mobile display digital interface (MDDI), a serial peripheral interface (SPI), an inter-integrated circuit (I2C), or a compact display port (CDP). According to one embodiment, the processor 140 and the display driver circuit 200 may be implemented as a MIPI interface, and the processor 140 and the first memory 130 may be implemented as an SPI interface.

The processor 140 may be involved in execution of the program stored in the first memory 130, and may transmit data necessary for operating the display panel 160 to the display driver circuit 200. According to one embodiment, the processor 140 may control a screen output based on change in a resolution value of the display panel 160 according to at least one of a user input or device change related to change in the resolution of the display panel 160 (e.g., folding change (folding or unfolding) of a foldable device, or rolling state change (screen enlargement or reduction due to rolling) of a rollable device).

According to various embodiments, the processor 140 may generate various instructions related to control of the display panel 160 related to an image output (e.g., instructions related to change of luminance of the display panel 160, control of a driving frequency of the display panel 160, and control of characteristics of an image output to the display panel 160 such as always on display (AOD) of the display panel), and may supply the generated instructions to the display driver circuit 200. According to one embodiment, the processor 140 may compress an image or a moving image of a specific resolution stored in the first memory 130 in a specified manner, and transmit the compressed screen input data to the display driver circuit 200.

The display panel 160 may display display data using the display driver circuit 200. In some embodiments, the display panel 160 may be embodied as a thin film transistor-liquid crystal display (TFT-LCD) panel, a light emitting diode (LED) display panel, a plasma display panel (PDP) panel, an electrophoretic display panel, and/or an electrowetting display panel, an organic LED (OLED) display panel, an active matrix OLED (AMOLED) display panel, or a flexible display panel. Further, the display panel 160 may be included in an on cell touch AMOLED (active matrix organic light-emitting diode) (OCTA) type display device. The display panel 160 may be of various types (e.g., add-on type, in-cell type) based on a location of the touch panel.

In an embodiment, the display panel 160 may be included in a display device that is configured to be able to slide and provides a screen (e.g., an image display screen). For example, a display area of the electronic device 100 may include an area in which a visually exposed image may be output. The electronic device 100 may adjust a size or a position of the display area (or the screen display area) according to a movement of a sliding plate (not shown) or a movement of the display. For example, the electronic device 100 may include a rollable type electronic device configured such that at least one portion (e.g., housing) is at least partially slidable to enable selective expansion of the display area. For example, the electronic device 100 may be referred to as a slide-out display or an expandable display. In one embodiment, the electronic device 100 may identify change in the display (e.g., a rollable, slidable, or foldable state), and may change the resolution based on the change in the display.

In the display panel 160, for example, gate lines and source lines may be arranged so as to intersect each other in a matrix form. A gate signal may be supplied to the gate lines. According to one embodiment, the gate signal may be sequentially supplied to the gate lines. According to various embodiments, a first gate signal may be supplied to odd-numbered gate lines among the gate lines, and a second gate signal may be supplied to even-numbered gate lines. The first gate signal and the second gate signal may be supplied alternately with each other. Alternatively, after the first gate signal is sequentially supplied to gate lines including a start line to an end line of the odd-numbered gate lines, the second gate signal may be sequentially supplied to gate lines including a start line to an end line of the even-numbered gate lines. A signal corresponding to the display data may be supplied to the source lines. The signal corresponding to the display data may be supplied from a source driver thereto under control of a timing controller of a logic circuit. According to one embodiment, the timing controller may control an overall operation of the display panel 160 and control input/output of data packets having the display data (e.g., data displayed through the display) according to a clock CLK. In this connection, the data packet may include the display data, a horizontal synchronization signal (Hsync), a vertical synchronization signal (Vsync), and/or a data enable signal (DE). For example, the horizontal synchronization signal is a signal indicating a time taken to display one horizontal line of a screen, and the vertical synchronization signal is a signal indicating a time taken to display a screen of one frame. Further, the data enable signal is a signal indicating a period for which a voltage (data voltage) is supplied to a pixel defined in the display panel 160. According to one embodiment, the display driver circuit 200 may receive data packets from the processor 140 through the interface, and may output the horizontal synchronization signal, the vertical synchronization signal, the data enable signal, the display data, and/or the clock.

The display panel 160 may include a plurality of gate lines and a plurality of source lines arranged in a matrix form, and light emitting elements connected to at least one thin film transistor (TFT). The display panel 160 may display a screen according to content execution. In this operation, the display panel 160 may output a screen based on a driving frequency according to operation of the display driver circuit 200. According to various embodiments, when resolutions of screen input data and screen output data are different from each other and a scaling function is turned on, the display panel 160 may be output an image scaled in a specific form (e.g., an image scaled based on the resolution of the display panel 160) via application of a scaling function of the display driver circuit 200.

The display driver circuit 200 may change the screen input data (or compressed screen data) transmitted from the processor 140 to a format that may be transmitted to the display panel 160, and may transmit the changed data (e.g., screen output data) to the display panel 160. The changed data (or output screen data) may be supplied on a pixel (or sub-pixel) basis. In this connection, the pixel has a structure in which red, green, and blue sub-pixels are arranged adjacently to each other in relation to a specified color display. One pixel may include RGB sub-pixels (RGB stripe layout structure) or RGBG sub-pixels (pentile layout structure). In this connection, an arrangement structure of the RGBG sub-pixels may be replaced with an arrangement structure of the RGBG sub-pixels. Alternatively, the arrangement structure of the sub-pixels may be replaced with an arrangement structure of RGBW sub-pixels.

According to an embodiment, the display driver circuit 200 may determine a resolution of the screen input data based on at least one portion of the screen input data (or compressed screen data) provided from the processor 140. The display driver circuit 200 may acquire a pre-stored setting corresponding to the determined resolution, and may apply the pre-stored setting to each of components of the display driver circuit 200 required to generate the screen output data on the display panel 160. For example, each of the components included in the display driver circuit 200 may perform scaling based on a setting specified based on the resolution of the screen input data transmitted from the processor 140, and may supply the scaled screen output data to the display panel 160. Accordingly, in relation to the scaling function of the display panel 160, the display driver circuit 200 may perform scaling based on the resolution of the screen input data while not receiving a separate instruction from the processor 140. In this regard, the display driver circuit 200 may store the setting in the second memory 270. The setting stored in the second memory 270 may include a setting to be applied to at least some components of the display driver circuit 200 based on the resolution of the screen input data. The second memory 270 may be embodied as a non-volatile memory that may store therein the setting when the display driver circuit 200 is turned off or the display panel 160 is turned off. According to one embodiment, the second memory 270 may include at least one register capable of storing therein settings of at least some components of the display driver circuit 200. When the display driver circuit 200 or the display panel 160 is changed from the turn-off state to the turn-on state, the second memory 270 may be accessed by a microprocessor included in the display driver circuit 200. The microprocessor may support, for example, image analysis and resolution determination functions of the screen input data.

As described above, the processor 140 (e.g., an application processor) may generate the screen input data (e.g., compressed screen data) and transmit the screen input data to the display driver circuit 200. The display driver circuit 200 may convert the screen input data received from the processor 140 into an electrical signal to be expressed as an optical signal in the display panel 160, and may transmit the converted electrical signal (or electrical output data) to the display panel 160). In the above-described process of converting the screen input data into the electrical output signal, with respect to the scaling function, the display driver circuit 200 may determine the resolution of the screen input data based on the screen input data transmitted from the processor 140 without an instruction from the processor 140. The display driver circuit 200 may adjust settings related to reading, compression, and scaling of the screen input data or maintain previous settings based on the resolution determination result and may convert the corresponding screen input data to the screen output data having a scale at which the screen output data may be outputted to the display panel 160. According to one embodiment, instructions to be transmitted to the display driver circuit 200 are not limited to the described embodiment. Some of the instructions may be omitted, or setting of some thereof may be merged and changed into one instruction.

Figure 2:
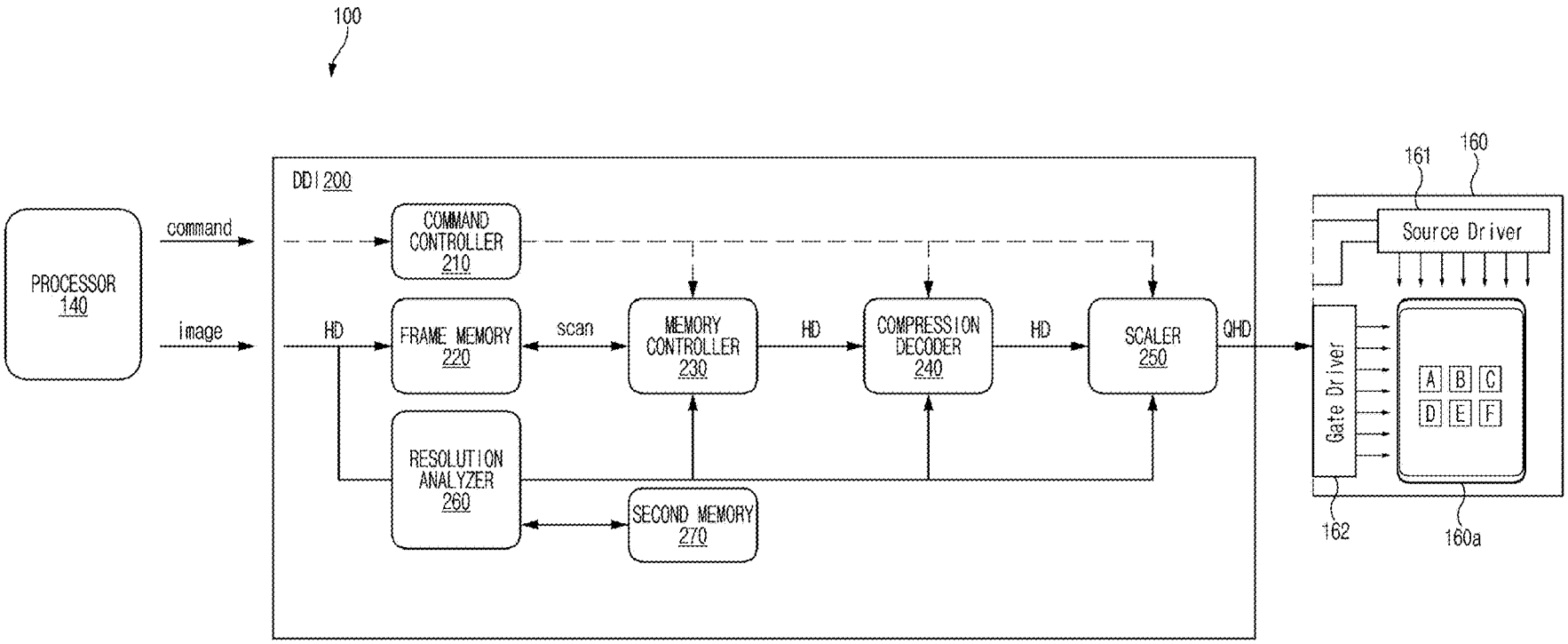
FIG. 2 is a diagram showing an example of some components of an electronic device related to a scaling function support according to an embodiment.

FIG. 2 is a view showing an example of some components of the electronic device related to scaling function support according to an embodiment.

Referring to FIG. 2, the electronic device 100 according to an embodiment may include the processor 140, the display driver circuit 200 (DDI: display driver IC), and the display panel 160.

The processor 140 (e.g., an application processor, a communication processor, a sensor hub, a tsp IC (a touch screen panel IC), etc.) may provide the screen input data (image) stored in the first memory 130 to the display driver circuit 200. Alternatively, the processor 140 may generate compressed screen data corresponding to the screen input data stored in the first memory 130, and may provide the generated compressed screen data (e.g., compressed format of data constituting a screen including at least one of an image or a text) to the display driver circuit 200. In this regard, the processor 140 may encode or compress the screen input data in a specified manner and then provide the encoded or compressed data to the display driver circuit 200 as the compressed screen data. According to one embodiment, the processor 140 may include a display controller, a compression encoder, an internal transmission interface (e.g., a mobile industry processor interface (MIPI) Tx) or a first serial interface.

The display controller may generate the screen input data to be transmitted to the display driver circuit 200 based on data transmitted from the CPU/GPU (a central processing unit/a graphic processing unit). The compression encoder may encode the screen input data generated by the display controller in a specified manner (e.g., a display stream compression (DSC) manner as specified by VESA) to generate the compressed screen data. Thus, the screen input data generated by the display controller may be compressed such that a data size thereof may be reduced. For example, a size of the screen input data generated by the display controller may be reduced to 1/n thereof via encoding thereof by the compression encoder. According to various embodiments, the compression encoder may be omitted. That is, the display controller may transmit the screen input data to the display driver circuit 200 without the compression process of the screen input data. The internal transmission interface may transmit the compressed screen data compressed by the compression encoder to the display driver circuit 200. The internal transmission interface may include, for example, a mobile industry processor interface (MIPI).

The processor 140 may provide information related to setting of the scaling function to the display driver circuit 200. For example, the processor 140 may collect information on whether the scaling function setting is in an on state or an off state, and provide the information to the display driver circuit 200. According to various embodiments, the processor 140 may collect information related to resolution change of the display panel 160 (e.g., change in a display area of a display panel of a foldable electronic device or change in a size of a display area of a display panel of a rollable electronic device) and may provide the information to the display driver circuit 200.

According to various embodiments, the sensor hub (or a sensor control processor) related to sensor operation of the electronic device 100 may be disposed therein. The electronic device 100 may include a signal line directly connected to and disposed between the sensor hub and the display driver circuit 200. In this case, a sensor information transmission function in which the processor 140 transmits sensor information to the display driver circuit 200 may be omitted. In response to this omission, the sensor hub may directly transmit sensor information to the display driver circuit 200. The information transmitted from the sensor hub to the display driver circuit 200 through the signal line as directly connected thereto may include sensor information related to a deformed state of the electronic device (e.g., sensor information regarding a folded or rolled state of the electronic device).

According to various embodiments, when there is no signal line directly connected to and disposed between the sensor hub and the display driver circuit 200 as above-described, the electronic device 100 may be configured such that the processor 140 collects a relevant signal from the sensor hub (when there is a wire for signal transmission and reception between the sensor hub and the processor 140) or directly collects the signal from the sensor (when there is a wire for signal transmission/reception between the sensor and the display driver circuit 200), and then transmits the collected information to the display driver circuit 200. According to one embodiment, the processor 140 may transmit a control signal (command) (or at least one instruction) to the display driver circuit 200 through the first serial interface. For example, the processor 140 may collect the sensor signal of at least one sensor included in the electronic device 100 (e.g., an acceleration sensor for detecting a deformed state of the electronic device), and may transmit the collected sensor signal to the display driver circuit 200 through the first serial interface.

The display driver circuit 200 may analyze the screen input data (or compressed screen data) delivered from the processor 140, and thus analyze the resolution of the screen input data (or compressed screen data) based on the analysis result, and then may acquire a predefined setting based on the resolution determination from the second memory 270. The display driver circuit 200 may adjust settings of components for reading, decompressing, and scaling of the screen input data (or compressed screen data) based on the values acquired from the second memory 270.

According to various embodiments, the display driver circuit 200 may include a command controller 210, a resolution analyzer 260 (or an analysis circuit or an analysis module) (at least one of a unit, a circuit, or a module), the second memory 270, a frame memory 220 (GRAM), a memory controller 230, a compression decoder 240, and/or a scaler 250. At least one of the compression decoder 240 or the scaler 250 may be embodied as one image processor (or an image processor). Alternatively, one image processor (e.g., an image processor) may include at least one of the compression decoder 240 or the scaler 250.

According to various embodiments, the display driver circuit 200 may include an internal reception interface (e.g., MIPI Rx), MIPI DSI (a MIPI display serial interface), an interface controller, or a second serial interface in relation to reception of the screen input data (or compressed screen data) and the instruction from the processor 140. The internal reception interface may communicate with the processor 140 to receive control information (or an instruction, or a control signal) and the screen input data (or compressed screen data) from the processor 140. The internal reception interface may include, for example, a MIPI receive circuit. When the internal reception interface receives the control information and the screen input data through the internal transmission interface (MIPI transmission circuit) of the processor 140, the internal reception interface may transmit the control information and the screen input data to the interface controller through the MIPI DSI. The MIPI DSI may be a component that may be added when the internal reception interface is designed to process MIPI type data. The MIPI DSI may be omitted or replaced with another component when changing the internal transmission interface and internal reception interface. The interface controller may receive the screen input data and/or the control information from the processor 140. The interface controller may transmit the received screen input data to the memory controller 230. The interface controller may transmit the received control information to the command controller 210. According to one embodiment, the interface controller may receive the sensor information through the second serial interface. For example, the interface controller may receive sensor information related to a deformed state of the electronic device related to the resolution change of the display panel 160 through the second serial interface, and transmit the sensor information to the resolution analyzer 260.

The resolution analyzer 260 may be disposed in the display driver circuit 200 and may be designed in a form of hardware. Alternatively, the resolution analyzer 260 may be provided in a form of a software module, and then may be written, in an embedded form, in a specific logic or microprocessor of the display driver circuit 200. The resolution analyzer 260 may operate in connection with execution of the scaling function of the display panel 160. For example, when the electronic device 100 is configured to provide a scaling function as a default function (or a basic function or a preset function), the resolution analyzer 260 may be positioned in front of the frame memory 220 (or between the processor 140 and the frame memory 220) and thus may detect a size (e.g., a size of a line data packet) of the screen input data provided from the processor 140 or the screen input data written in the frame memory 220. According to one embodiment, the resolution analyzer 260 may count (or calculate) and identify (or determine) a size of a first line data packet of the screen input data provided from the processor 140. The resolution analyzer 260 may acquire (or obtain) a setting corresponding to the identified resolution of the screen input data from the second memory 270.

According to various embodiments, settings of at least some components of the display driver circuit 200, based on the resolution of the screen input data (or compressed screen data) may be pre-stored in the second memory 270. The settings may be stored, for example, in a form of a lookup table or a setting table. According to various embodiments, the settings may include settings to be applied to at least some components of the display driver circuit 200, based on the resolution of the screen input data and the resolution of the display panel 160. For example, the settings may include at least one of a setting of the memory controller 230, a setting of the compression decoder 240, or a setting of the scaler 250 for scaling a first input resolution (e.g., the resolution of the screen input data) to a first output resolution (e.g., the resolution of the screen output data). In this connection, when uncompressed screen input data is received from the processor 140, the compression decoder 240 and a configuration of a related setting may be omitted from the display driver circuit 200. Alternatively, the settings may include at least one of a setting of the memory controller 230, a setting of the compression decoder 240, or a setting of the scaler 250 for scaling screen input data having a second input resolution different from the first input resolution to a second output resolution different from the first output resolution.

As described above, the resolution analyzer 260 may acquire the settings necessary for scaling at least one resolution of the screen input data to at least one resolution of the screen output data from the second memory 270 and then may deliver the acquired settings to at least one component of the display driver circuit 200. According to various embodiments, the display driver circuit 200 may not include the separate second memory 270 and rather, may calculate the settings for scaling of least some components of the display driver circuit 200 in real time, based on the resolution of the screen input data detected by the resolution analyzer 260, and may then provide the calculated value to at least some components of the display driver circuit 200.

The memory controller 230 may write the screen input data received from the interface controller to the frame memory 220. For example, the memory controller 230 may write the corresponding screen input data to the frame memory 220 according to a frame rate of the screen input data transmitted from the processor 140. According to various embodiments, the memory controller 230 may receive a setting related to scaling from the resolution analyzer 260. The memory controller 230 may control a reading operation of the screen input data written in the frame memory 220 according to the received scaling-related setting. The memory controller 230 may transmit data read via scanning of the frame memory 220 to the compression decoder 240. According to one embodiment, the memory controller 230 may perform a scan operation of the frame memory 220 such as HD data reading, FHD data reading, or QHD data reading, based on the resolution of the screen input data.

The frame memory 220 may include a graphic RAM (GRAM). The frame memory 220 may store therein the screen input data transmitted from the processor 140 (or an interface controller communicating with the processor 140). The stored screen input data may include compressed screen data compressed by the processor 140 or screen input data in an uncompressed state. The frame memory 220 may include a memory space corresponding to the resolution and/or the number of color gradations of the display panel 160. The frame memory 220 may include a frame buffer or a line buffer. The frame memory 220 may have the number of update times or an update speed varying depending on a type of an image output to the display panel 160. For example, when a moving image is reproduced, screen input data corresponding to a frame of the corresponding moving image may be written into the frame memory 220 at a specified speed. Regarding a still image, the frame memory 220 may store therein a previous still image until an image update occurs. The screen input data stored in the frame memory 220 may include a coordinate value to be displayed in each display area of the display panel 160, or an order in which the screen input data are written in the frame memory 220 may correspond to a coordinate to be displayed on the display panel 160.

The command controller 210 may control the memory controller 230, the compression decoder 240, the scaler 250 and a display timing controller to apply a corresponding color change value to each of the screen input data stored in the frame memory 220 and then output the application result to a designated area of the display panel 160. The command controller 210 may be referred to as a control logic. The command controller 210 may control timings of components included in the display driver circuit 200. For example, the command controller 210 may adjust a timing at which the screen input data received from the processor 140 is stored in the frame memory 220, and a timing at which the memory controller 230 reads the screen input data stored in the frame memory 220 so that both the timings do not overlap each other. Under control of the command controller 210, the memory controller 230 may control a timing at which the memory controller 230 reads the screen input data stored in the frame memory 220 at a specified frame rate, and transfers the read screen input data to the compression decoder 240 and the scaler 250. The writing and reading of the data into and from the frame memory 220 and the control of the timings of the compression decoder 240 and the scaler 250 may be controlled by the display timing controller.

When at least one portion of the compressed screen data read from the frame memory 220 under the control of the memory controller 230 is encoded, the compression decoder 240 may decode the at least one portion in a specified manner. When application of the scaling function is turned on, the compression decoder 240 may transmit the decoded data to the scaler 250. When the application of the scaling function is turned off, the compression decoder 240 may transmit the decoded data to the display timing controller. For example, when the size of the screen input data has been compressed to 1/n thereof by the compression encoder of the processor 140, the compression decoder 240 may decompress the compressed at least one portion of the screen data, and thus may restore the same to the screen input data before compression. According to various embodiments, when the at least one portion of the screen input data transmitted from the processor 140 is not encoded, the compression decoder 240 may be omitted or bypassed.

According to various embodiments, the compression decoder 240 may receive the setting provided from the resolution analyzer 260, based on the resolution of the compressed screen data provided from the processor 140. The compression decoder 240 may execute decoding of the compressed screen data provided from the memory controller 230, based on the setting provided from the resolution analyzer 260. For example, the compression decoder 240 may identify a resolution value of the compressed screen data to be decompressed based on the setting provided from the resolution analyzer 260, and may decode the compressed screen data, based on the resolution value of data to be output to the display panel 160.

The scaler 250 may be implemented as a hardware processor capable of executing a scaling or image pre-processing function of the data decoded by the compression decoder 240, or may be provided in a form of a software block and then be loaded into the display driver circuit. The scaler 250 may perform an up-scaling function that enlarges the decompressed image (e.g., the screen input data) by a specified scaling factor. According to one embodiment, upon determination that it is necessary to enlarge the screen output data, based on the size of the screen output data to be output to the display panel 160 or a user setting, the scaler 250 may enlarge a corresponding screen input data. The enlarged screen output data may be transmitted to the display timing controller. For example, the scaler 250 may interpolate low-resolution screen input data (or screen data) with high-resolution screen output data (e.g., when the screen input data is HD, x4 (HD) may be upscaled to 1.78 (FHD) such that input data may be scaled to QHD output data). When at least one portion of the screen input data does not require enlargement, the upscaling function of the scaler 250 may be omitted or bypassed (e.g., the screen input data is transmitted as the screen output data). The scaler 250 may perform a pre-processing function for improving an image quality of the screen input data. The scaler 250 may include, for example, a pixel data processing circuit, a pre-processing circuit, and a gating circuit.

According to various embodiments, the scaler 250 may receive a setting corresponding to a resolution of the screen input data currently input from the resolution analyzer 260. In this process, the scaler 250 may identify a resolution value of decompressed screen data (e.g., the screen data delivered from the compression decoder 240 or the screen input data which is not subjected to compression and is provided) as currently input, based on the setting provided from the resolution analyzer 260, and may perform scaling based on a resolution value of the display panel 160 identified based on the setting. The scaler 250 may supply the screen output data that has been scaled (e.g., data scaled to QHD when the resolution of the display panel 160 is QHD) to the display panel 160 via the display timing controller. According to various embodiments, the compression decoder 240 and the scaler 250 may constitute one image processor (or image processor). The display timing controller (not shown) or a shift register (not shown) may be included in the display driver circuit 200 and may be disposed between the scaler 250 and the display panel 160.

According to various embodiments, the display timing controller may transmit the screen output data received from the scaler 250 to a source driver 161 under the control of the command controller 210, and may control gate signal output from a gate driver 162. According to one embodiment, the display timing controller may be included in the command controller 210. The display timing controller may convert the screen output data received through the scaler 250 into an image signal and supply the image signal to the source driver 161 or the gate driver 162 of the display panel 160. The screen output data scaled by the scaler 250 may be stored in the shift register related to an operation of the display panel 160.

According to various embodiments, the shift register may receive the screen output data processed by the scaler 250, and transmit the received screen output data to the source driver 161 under control of the display timing controller. Additionally, the display driver circuit 200 may include an internal oscillator. The internal oscillator may generate a timing signal required for operation of the display timing controller, and transmit the generated timing signal to the display timing controller.

The display panel 160 may include the source driver 161, the gate driver 162 and a panel unit 160*a*. Additionally, the display panel 160 may further include a touch panel and a touch IC, a pressure sensor and a pressure sensor IC, or a digitizer related to a user input. According to various embodiments, the panel unit 160*a* may be included in the display panel 160, and the source driver 161 and the gate driver 162 may be included in the display driver circuit 200 under division of a circuit.

The display panel 160 may display various information (e.g., information including at least one of multimedia data or text data) to the user. The display panel 160 may include, for example, a liquid-crystal display (LCD) panel or an active-matrix organic light-emitting diode (AM-OLED) panel. The display panel 160 may be implemented, for example, to be flexible, transparent, or wearable. Further, the display panel 160 may be included in, for example, a cover of a casing electrically coupled to the electronic device 100.

The display panel 160 may receive the screen output data from the display driver circuit 200, and display a screen corresponding to the screen output data. A plurality of data lines and a plurality of gate lines may intersect each other in the display panel 160. A plurality of pixels may be positioned at intersections therebetween, respectively. When the display panel 160 is embodied as the OLED panel, each of the plurality of pixels may include at least one switching element (e.g., FET) and one OLED. Each pixel may receive an image signal or the like from the display driver circuit 200 at a predetermined timing and emit light. The display panel 160 may have, for example, a specific resolution (e.g., a resolution of 1536 (number of horizontal lines)×2152 (number of vertical lines)).

According to various embodiments, when the electronic device 100 is embodied as a rollable display device, a screen area in which an image may be displayed may vary according to an unrolling or rolling operation of the display. Accordingly, a resolution (effective resolution: resolution based on the number of pixels in the display area that may display an image based on a rolling state) of the display panel 160 may be changed. According to various embodiments, when the electronic device 100 is embodied as a foldable electronic device, a type of the display panel from which the screen is output or an effective area of the display panel where the screen is able to be displayed may be changed, based on a folded state of the electronic device 100. Thus, the resolution of the display panel 160 may be changed. When the resolution of the display panel 160 is changed, the display driver circuit 200 may adjust the resolution of the screen output data correspondingly. In this regard, the second memory 270 of the display driver circuit 200 may include a parameter (or an index) corresponding to the resolution change of the display panel 160. According to one embodiment, the second memory 270 has a search value having the resolution of the screen input data and the current resolution of the display panel 160 as an index, and settings of at least some components of the display driver circuit 200 for supporting the scaling function based on the search value. Alternatively, the resolution analyzer 260 may include a hardware logic (or a software module) capable of calculating the settings of at least some of the display driver circuit 200 based on the resolution of the screen input data and the current resolution of the display panel 160. The resolution analyzer 260 may calculate the settings in a certain period or in real time and may supply the calculated settings to the at least some components of the display driver circuit 200.

Each of the source driver 161 and the gate driver 162 may generate a signal to be supplied to each of a scan line and a data line as not shown of the display panel 160, based on each of a source control signal and a gate control signal received from the display timing controller.

Figure 3:
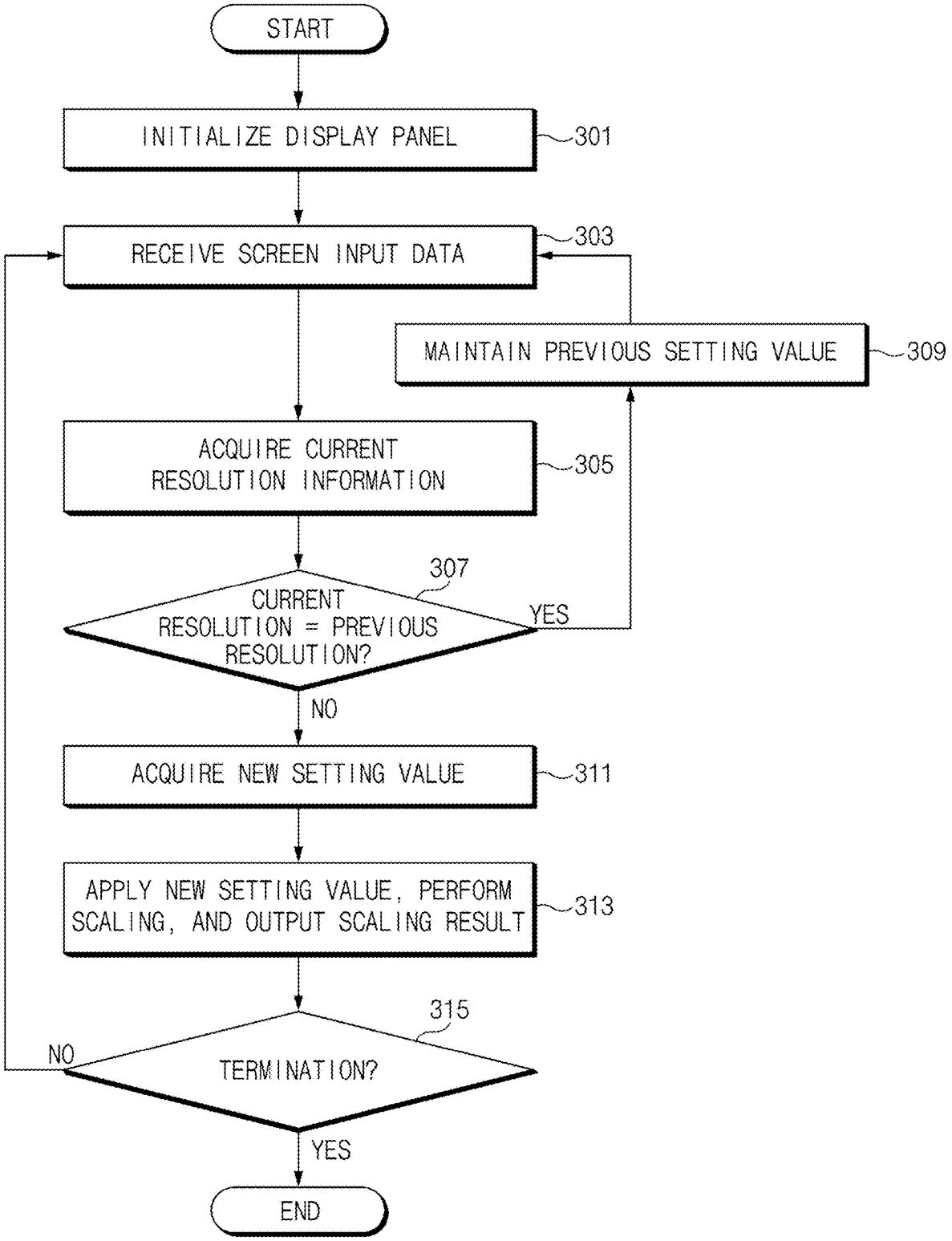
FIG. 3 is a view showing an example of a method for operating an electronic device according to various embodiments.

FIG. 3 is a view showing an example of a method for operating an electronic device according to various embodiments.

Referring to FIG. 3, in relation to the method for operating the electronic device 100 according to one embodiment, the display driver circuit 200 may perform an initialization operation of the display panel 160 in operation 301. For example, when the electronic device 100 executes a sleep or deep sleep function, the display panel 160 may have a turned-off state. According to one embodiment, when a user input or an external input event (e.g., an event that requires turn-on of the display panel 160 such as a call reception or message reception, system message occurrence, etc.) occurs, the display driver circuit 200 and the display panel 160 may perform an initialization operation. In the initialization operation, the display driver circuit 200 may pre-designate, as presets, settings required in a system (a controller group (the command controller, the memory controller, and the display timing controller), the image processor (the compression decoder and the scaler)) relative to each of resolution values of the screen input data. For example, the resolution analyzer 260 of the display driver circuit 200 may provide settings corresponding to a resolution of an initial screen input data output via the initialization process of the display panel 160 and the resolution of the display panel 160 among the settings stored in the second memory 270 to a certain component, for example, to at least the scaler 250 (or at least one of the memory controller 230, the compression decoder 240, or the scaler 250). The number of presets (e.g., the number of resolution divisions of the screen input data) may be adjusted based on the number of resolution scaling factors supported by the display device.

In operation 303, the display driver circuit 200 may receive the screen input data provided from the processor 140 (or the compressed screen data; hereinafter, assuming that the compressed data is provided, an example in which the display driver circuit 200 receives the compressed screen data will be described; however, when the screen input data is not compressed, the compression decoder 240 may be bypassed or the compression decoder 240 may be omitted from the display driver circuit 200 by design).

In operation 305, the resolution analyzer 260 of the display driver circuit 200 may acquire current resolution information of the compressed screen data based on at least one portion (e.g., a data packet of a first line) of the compressed screen data. In this regard, the resolution analyzer 260 may include a counter capable of detecting a data packet size of the first line of the compressed screen data, and may detect the packet size based on the counter. The resolution analyzer 260 may identify resolution information mapped to the packet size. In this process, the resolution analyzer 260 may refer to the second memory 270, and the second memory 270 may store therein resolution data mapped to the data packet size of the first line in relation to the resolution information. According to various embodiments, when the electronic device 100 is configured not to perform the compression, the resolution analyzer 260 may acquire current resolution information based on original data (e.g., a data packet of a first line of the original data) instead of the compressed data. According to various embodiments, the display driver circuit 200 may identify a size of all of frames of the compressed screen data (or a size of all of frames of the original data), and may determine the current resolution information based on the identified size.

In relation to performing operation 307, the resolution analyzer 260 of the display driver circuit 200 may identify whether the current resolution of the compressed screen data is the same as a previous resolution. According to one embodiment, the resolution analyzer 260 may store therein and manage a previous resolution value of the previous compressed screen data.

When the current resolution of the current compressed screen data is the same as the previous resolution in operation 307, the resolution analyzer 260 may maintain the setting related to scaling of the display driver circuit 200 as a previous setting in operation 309. For example, the resolution analyzer 260 does not perform a scaling-related setting adjustment operation, or may deliver information indicating that the current resolution is the same as the previous resolution to each of the components (e.g., at least one of the memory controller 230, the compression decoder 240, or the scaler 250) of the display driver circuit 200. Thereafter, the method may branch to operation 303 in which the display driver circuit 200 may re-perform the corresponding operation 303 and subsequent operations.

When, in operation 307, the current resolution of the current compressed screen data is different from the previous resolution, the resolution analyzer 260 may acquire a new setting related to scaling of the display driver circuit 200 corresponding to the current detected resolution from the second memory 270 in operation 311.

For example, when a size of the first line is 720, the resolution analyzer 260 may determine that the screen input data has a resolution of HD, and correspondingly, acquire a setting preset A from the second memory 270. When the size of the first line is 1080, the resolution analyzer 260 may determine that the screen input data has a resolution of FHD, and correspondingly, acquire a setting preset B from the second memory 270. When the size of the first line is 1440, the resolution analyzer 260 may determine that the screen input data has a resolution of QHD, and correspondingly, acquire a setting preset C from the second memory 270.

In operation 313, the resolution analyzer 260 of the display driver circuit 200 may transmit the acquired new setting to each of the components of the display driver circuit 200 related to the scaling such that each of the components may perform at least one of reading, decoding, and scaling of the compressed screen data stored in the frame memory 220. The display driver circuit 200 (e.g., the scaler 250) may output the scaled screen output data to the display panel 160.

In operation 315, the display driver circuit 200 may identify whether an event related to termination of the display panel 160 occurs. The termination of the display panel 160 may include, for example, a state in which a screen is not displayed on the display panel 160 (e.g., a turned-off state of the display panel 160). When the event related to the termination occurs, the display driver circuit 200 may be turned off. When the event related to the termination does not occurs, the method may branch to operation 303 in which the display driver circuit 200 may re-perform the corresponding operation 303 and subsequent operations thereto. When the display panel 160 is turned on again after the termination of the display panel 160, the method may proceed operation before operation 301 and may re-perform subsequent operations thereto.

Figure 4:
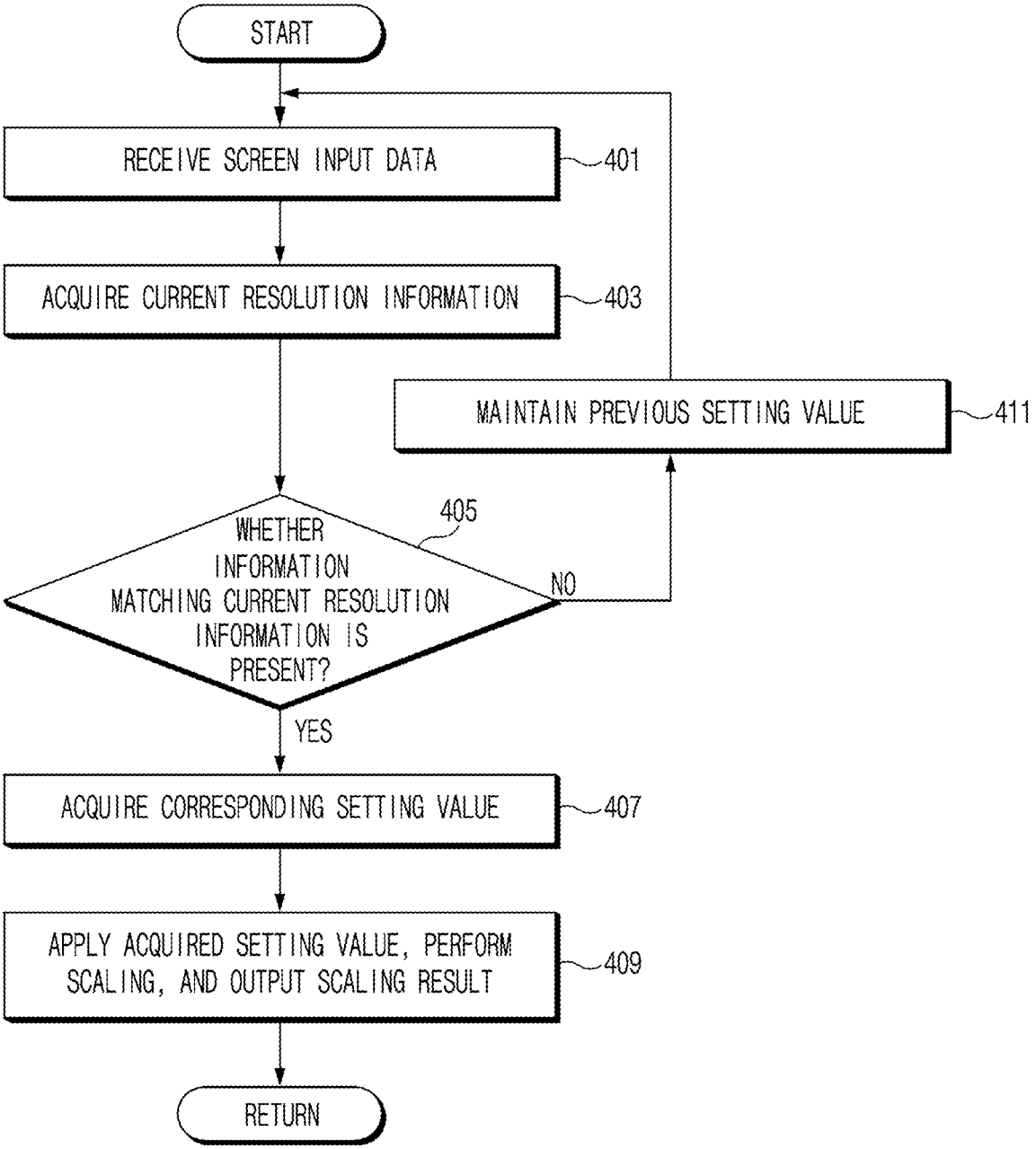
FIG. 4 is a view showing another example of a method for operating an electronic device according to various embodiments.

FIG. 4 is a view showing another example of a method for operating an electronic device according to various embodiments.

Referring to FIG. 4, in relation to the method for operating the electronic device 100 according to one embodiment, the resolution analyzer 260 of the display driver circuit 200 may receive the compressed screen data from the processor 140 in operation 401. In this connection, the processor 140 may provide uncompressed screen input data to the display driver circuit 200. In following descriptions, an example in which the processor 140 provides the compressed screen data thereto will be described.

In operation 403, the resolution analyzer 260 may acquire current resolution information of current input compressed screen data, based on at least one portion of the compressed screen data. For example, the resolution analyzer 260 may count a data packet size of a first line of the compressed screen data, and determine a resolution of the compressed screen data based on the count information. Alternatively, the resolution analyzer 260 may determine the resolution with referring to a lookup table storing therein resolution information mapped to the count information.

In relation to performing operation 405, the resolution analyzer 260 may identify whether information matching the acquired resolution information exists in a setting table pre-stored in the second memory 270.

In operation 405, when information corresponding to the acquired resolution information exists in the pre-stored setting table, the resolution analyzer 260 of the display driver circuit 200 may acquire a setting corresponding to the resolution information in operation 407. According to various embodiments, the resolution analyzer 260 may acquire the setting based on a data packet size of a first line of the acquired compressed screen data without performing the resolution determination in operation 403. For example, when a size of the first line is 720, the resolution analyzer 260 may acquire the setting preset A from the second memory 270 correspondingly. When the size of the first line is 1080, the resolution analyzer 260 may acquire the setting preset B from the second memory 270 correspondingly. When the size of the first line is 1440, the resolution analyzer 260 may acquire the setting preset C from the second memory 270 correspondingly.

In operation 409, the resolution analyzer 260 may perform application of the acquired setting, perform scaling and output the scaling result. For example, the resolution analyzer 260 may provide the acquired setting (e.g., one of the preset A, the preset B, and the preset C) to each of the component of the display driver circuit 200 related to scaling (e.g., to at least one of the memory controller 230, the compression decoder 240, and the scaler 250). The display driver circuit 200 may perform the scaling of the compressed screen data based on the setting provided from the resolution analyzer 260. For example, the display driver circuit 200 may apply HD size input setting and x4 the scaler 250 setting in response to the application of the preset A. The display driver circuit 200 may apply FHD size input setting and x1.78 scaler 250 setting in response to the application of the preset B. When the resolution of the display panel 160 is QHD, the display driver circuit 200 may generate the screen output data without QHD size input setting and scaling, in response to the application of the preset C. The display driver circuit 200 may output the screen output data as scaled in response to the application of each preset to the display panel 160. Thereafter, the display driver circuit 200 may return to operation before operation 401 and may re-perform subsequent operations thereto until termination event of the display panel 160 occurs.

In operation 405, when information matching the acquired resolution information does not exist in the setting table, the resolution analyzer 260 of the display driver circuit 200 may maintain the previous setting in operation 409. The method may branch to operation before operation 401, and re-perform subsequent operations thereto. As the previous setting is maintained, the display driver circuit 200 may apply the previous setting to input data (e.g., compressed screen data) and output the application result to the display panel 160. According to various embodiments, when the display driver circuit 200 cannot find information corresponding to the data packet size of the first line of the compressed screen data in the second memory 270, the display driver circuit 200 may determine this situation as a transmission or setting error, or may determine this situation as resolution change in which the information is not stored in the second memory 270, and thus the display driver circuit 200 may perform a scaling operation based on a preset setting that applies PSR (Panel self-refresh). According to one embodiment, the display driver circuit 200 may receive an instruction related to scaling from the processor 140 and, according to the received instruction, may apply a setting related to scaling to a component related to scaling to generate the screen output data, and then may provide the generated screen output data to the display panel 160.

Figure 5:
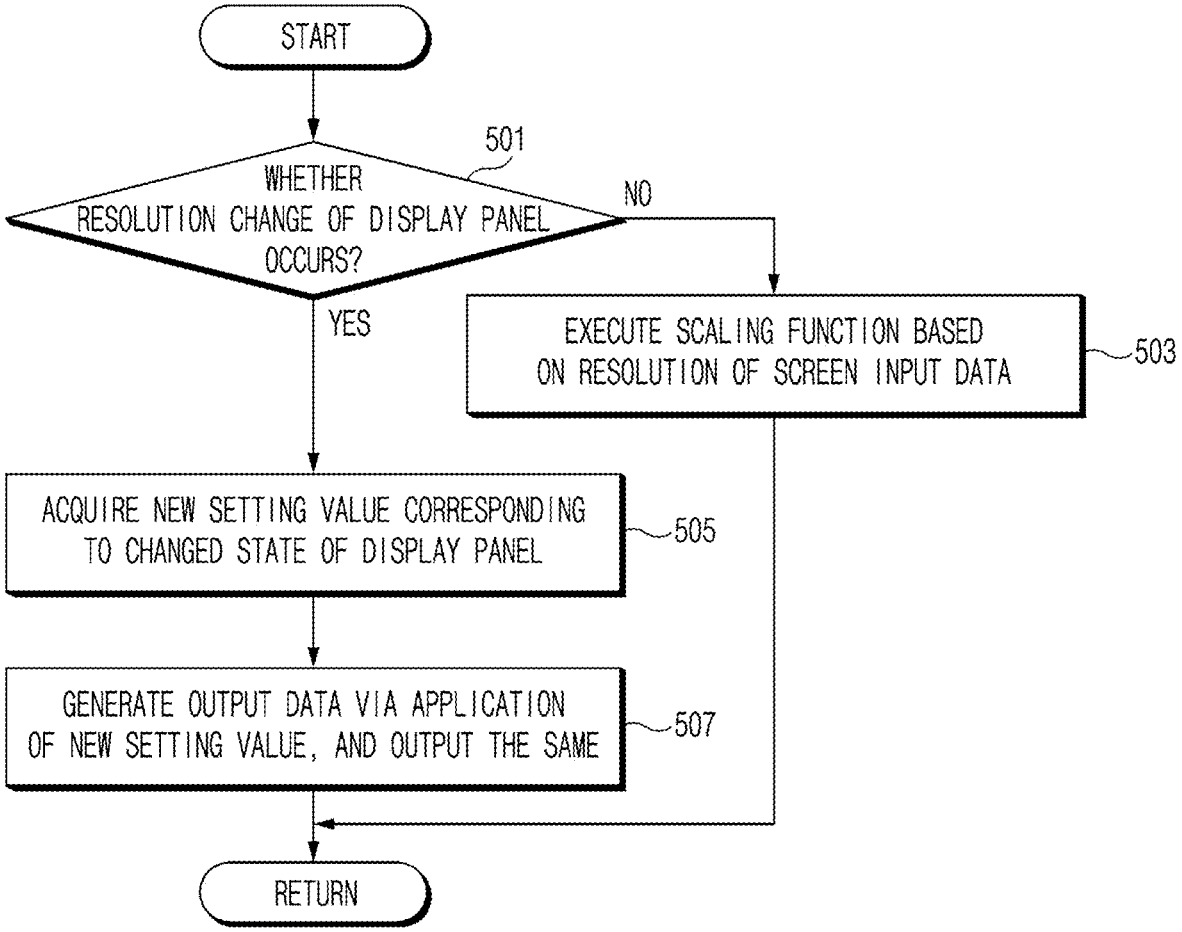
FIG. 5 is a view showing still another example of a method for operating an electronic device according to various embodiments.

FIG. 5 is a view showing still another example of a method for operating an electronic device according to various embodiments.

In relation to the method for operating the electronic device 100 according to an embodiment, when the scaling function is turned on from a turned-off state, the display driver circuit 200 may receive an instruction related to execution of the scaling function from the processor 140. Alternatively, when the scaling function is turned on by default, and when the display panel 160 changes from a turned-off state to a turned-on state or maintains a turned-on state, the display driver circuit 200 may perform resolution analysis of the compressed screen data related to the scaling function.

Referring to FIG. 5, in relation to performing operation 501, the display driver circuit 200 may identify whether a signal corresponding to resolution change of the display panel 160 has been received from the processor 140. According to various embodiments, the display driver circuit 200 may directly receive the signal corresponding to the resolution change of the display panel 160 (e.g., a sensing signal according to change in a size of the screen display area of the display panel 160) from the sensor hub or the sensor.

When, in operation 501, the signal corresponding to the resolution change of the display panel 160 has not been received, the display driver circuit 200 may execute the scaling function based on the resolution of the screen input data as described in FIG. 3 or FIG. 4 above in operation 503.

When in operation 501, the signal corresponding to the resolution change has been received, the display driver circuit 200 may check the setting table pre-stored in the second memory 270 and acquire a new setting corresponding to the changed state of the display panel 160 from the table in operation 505.

In operation 507, the display driver circuit 200 may transmit the new setting to each of the components (e.g., the scaler 250) of the display driver circuit 200 related to the scaling, and may generate output data via application of the new setting, and may output the data to the display panel 160. Thereafter, the display driver circuit 200 may return to operation before operation 501 and re-perform subsequent operations thereto until a termination event of the display panel 160 occurs.

According to various embodiments, when the resolution of the screen input data and the resolution of the display panel 160 are changed at the same time, the methods for operating the display as described above in FIG. 4 and FIG. 5 may be performed simultaneously. For example, the resolution analyzer 260 may detect the settings mapped to the resolution of the compressed screen data corresponding to the screen input data and the changed resolution of the display panel 160 from the setting table, and may generate output data to be output to the display panel 160, based on the detected setting s. The setting table may include at least one setting. The at least one setting may include a setting to be provided to the at least one component of the display driver circuit 200 related to the scaling function.

Figure 6A:
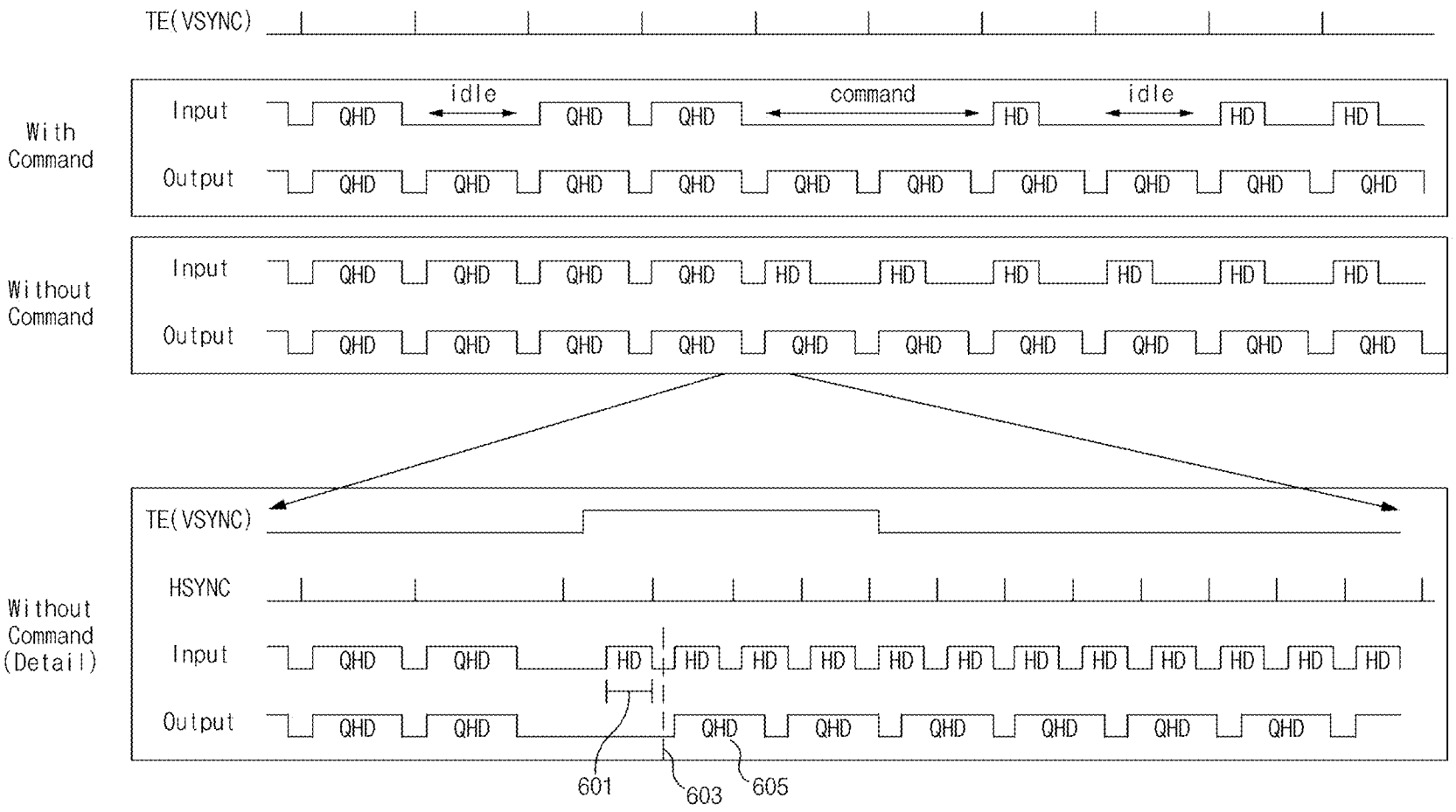
FIG. 6A is a diagram showing a signal timing diagram related to an operation of an electronic device according to various embodiments.

FIG. 6A is a diagram showing a signal timing diagram related to operation of an electronic device according to various embodiments.

Because the processor 140 cannot guarantee a transmission order of the instruction and the screen input data, the display driver circuit 200 may receive and store a setting related to, for example, a scan area of the frame memory 220, a compression decoding size, or a scaling factor from the processor 140 before receiving the screen input data. The display driver circuit 200 may perform synchronization by changing the resolution when the screen input data is input thereto.

Referring to FIG. 6A, in an electronic device supporting a function related to scaling, the processor 140 may transmit an instruction related to the scaling process to the display driver circuit 200. The display driver circuit 200 may generate the screen output data (Output) based on change of a resolution of the screen input data (Input) from a first resolution (e.g., QHD) to a second resolution (e.g., HD) as in a With Command timing diagram of the drawing (e.g., a timing diagram corresponding to some section of a plurality of frames; one section corresponds to one frame data; 1 frame corresponds to one screen of the display panel 160). Then, the display driver circuit 200 may output the screen output data (Output) to the display panel 160. In this operation, in each of a section for which the display driver circuit 200 supplies the first resolution (QHD) and a section for which the display driver circuit 200 supplies the second resolution (HD), an idle period may be required in relation to data output stabilization and synchronization of various instructions applied to output data, and a reception period (command) of an instruction related to scaling setting may be required. Thus, the display driver circuit 200 may perform unnecessary PSR in each of the idle period of the first resolution (QHD) and the idle period of the second resolution (HD), and may perform PSR in the instruction receiving period. As described above, upon receiving the scaling related instruction from the processor 140, the display driver circuit 200 is required to perform unnecessary PSR. In relation to the setting of the resolution-related function (the memory controller and the compression decoder) and the setting of the scaling factor of the scaler, a screen disconnection may occur. A screen stop phenomenon or screen flickering phenomenon may occur due to re-outputting or maintenance (PSR) of the previous screen.

In an embodiment of the disclosure, when the electronic device 100 using the scaler to which various resolution scaling factors may be applied changes the size of the screen input data or turns the scaling function on or off, the electronic device 100 may be configured to allow the display driver circuit 200 to perform the setting of the resolution-related function (the memory controller and the compression decoder) and the setting of the scaling factor of the scaler. Thus, the electronic device 100 may support seamless image output without disconnection of a separate screen input data (Input) or of the screen output data related to the scaling as in a Without Command timing diagram of the drawing (e.g., one section corresponds to one frame transmission section).

According to various embodiments, the display driver circuit 200 of the electronic device 100 may have a difference of one horizontal period between timings of the screen input data (Input) and the screen output data (Output) in relation to writing and reading operations of the screen input data, as in a Without Command (Detail) timing diagram (e.g., a timing diagram corresponding to some sections of one frame; one section corresponds to one line data). For example, the display driver circuit 200 receives the screen input data (Input) of the first resolution (QHD) from the processor 140, and then a resolution of an input image (e.g., screen input data) may be changed to the second resolution (HD) according to content change or a user input. When the resolution of the screen input data (Input) has been changed to the second resolution (HD), the resolution analyzer 260 of the display driver circuit 200 may analyze a size of data of a first section 601 (first line data of the frame). The resolution analyzer 260 may determine the resolution based on a result of data size analysis of the first section 601, and may apply a setting corresponding to the changed second resolution (HD) to the components of the display driver circuit 200 related to the scaling since a time point 603 after the first section 601. Accordingly, the scaled screen output data 605 may be supplied to the display panel 160 for a section for which second line data of the changed second resolution (HD) is supplied.

In the above descriptions, a case has been described in which the size of the first line data of one frame (or the first line data of the screen input data corresponding to one frame) is detected and the resolution is determined based on the detected size. However, the disclosure is not limited thereto. For example, for accuracy, the resolution analyzer 260 may identify sizes of the data packets of the first and second lines and then perform resolution analysis based on an average value thereof.

Figure 6B:
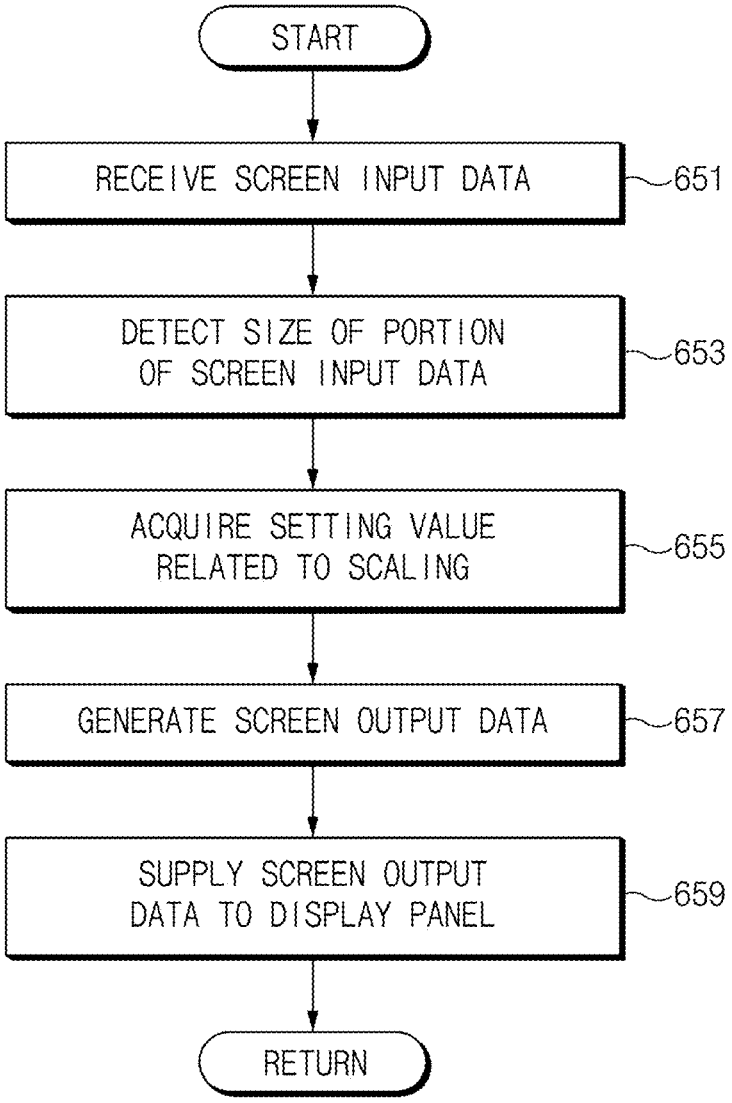
FIG. 6B is a view showing an example of a method for operating a display driver circuit according to various embodiments.

FIG. 6B is a view showing an example of a method for operating a display driver circuit according to various embodiments.

Referring to FIG. 6B, in relation to the method for operating the display driver circuit 200 (e.g., the method for controlling scaling of the display), in 651 operation, the display driver circuit 200 may receive screen input data from the processor 140.

In operation 653, the display driver circuit 200 may detect a size of a portion of the received screen input data. Then, in operation 655, the display driver circuit 200 may acquire a setting related to scaling of the screen input data based on the detected size.

The display driver circuit 200 may generate screen output data corresponding to a resolution of the display panel based on the acquired setting in operation 657. Then, in operation 659, the display driver circuit 200 may supply the generated screen output data to the display panel 160. Thereafter, the display driver circuit 200 may return to operation 651 and re-perform subsequent operations thereto until a termination event of the display panel 160.

With respect to the method for operating the display driver circuit 200 as described above in FIG. 6B, each of the operations in FIG. 6B may selectively employ at least one operation among the various operations as described in FIG. 1 to FIG. 6A above. For example, the display driver circuit 200 may perform an operation of detecting the size (or the size of data, the number of data) of the first line data packet of the screen input data in operation 653. The display driver circuit 200 may acquire a setting based on the detected size value without performing resolution determination when acquiring (or obtaining) the setting related to scaling. In this operation, the display driver circuit 200 may perform real-time calculation or acquisition of a setting pre-stored in a memory (e.g., the second memory 270). When generating the screen output data, the display driver circuit 200 may perform compression decoding or bypass (e.g., skip) the compression decoding, based on characteristics (e.g., whether the data is compressed) of the screen input data. When the display driver circuit 200 generates the screen output data, the display driver circuit 200 may generate the screen output data that matches the resolution of the display panel 160. In this connection, when the resolution of the display panel 160 has been changed, the display driver circuit 200 may generate the screen output data matching the changed resolution of the display panel 160.

Figure 6C:
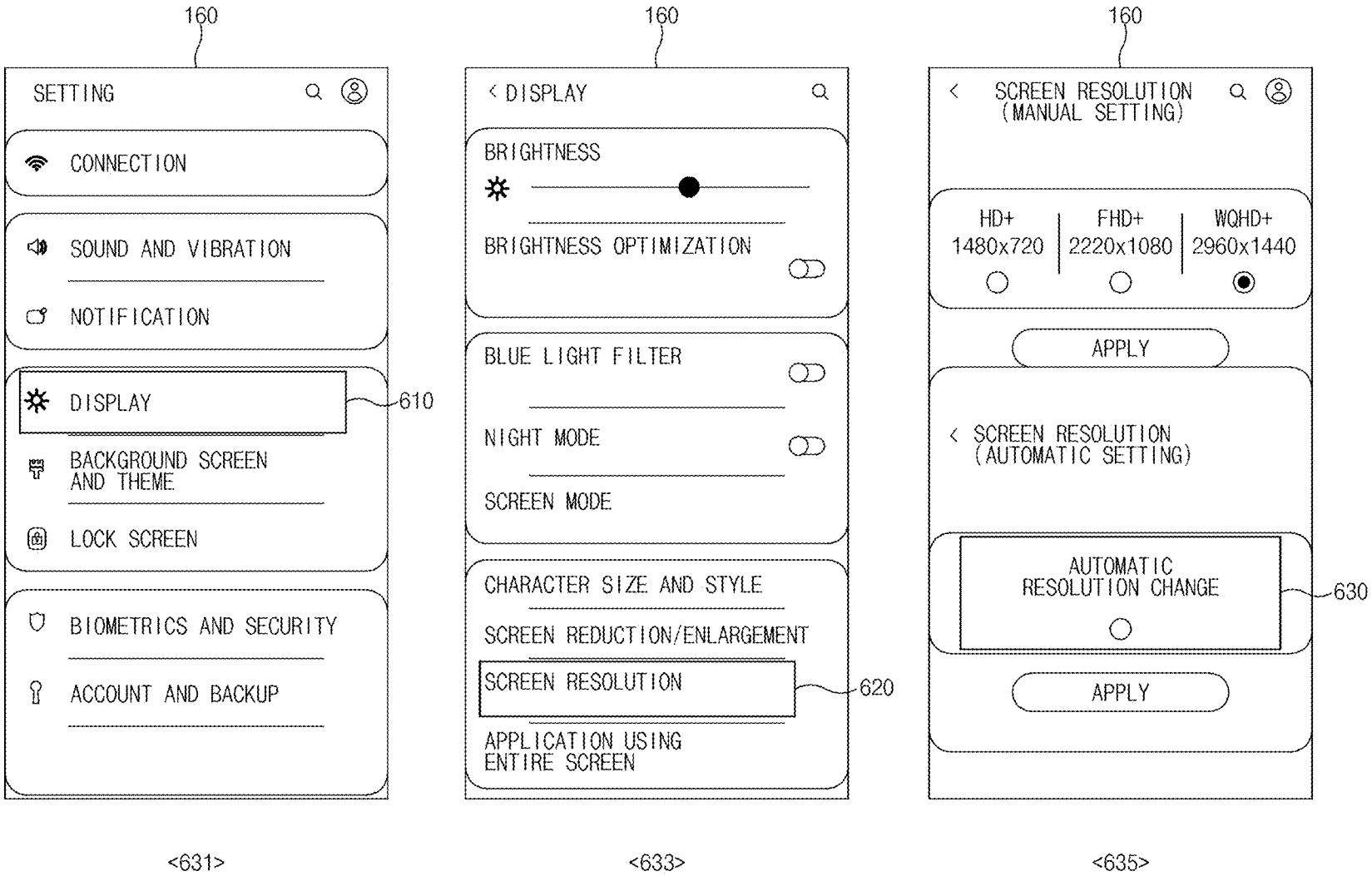
FIG. 6C is a view showing an example of a screen interface related to display resolution setting according to various embodiments.

FIG. 6C is a view showing an example of a screen interface related to display resolution setting according to various embodiments.

Referring to FIG. 6C, in response to a user input (e.g., a touch input, a voice input, or a physical key button input), the display panel 160 of the electronic device may output a setting screen as shown in a state 631. In this regard, the display panel 160 may output an icon or a menu related to entering the setting screen. The setting screen may include, for example, setting items related to various functions of the electronic device (e.g., connection settings, sound and vibration settings, notification settings, display settings, background screen and theme settings, lock screen settings, biometrics and security settings, or account and backup settings).

When a user input (e.g., a touch input) for selecting a display setting item 610 occurs, the display panel 160 of the electronic device may output a screen related to the display setting as shown in a state 633. The screen related to the display setting may include, for example, at least, brightness settings, character size and style settings, and screen resolution settings. When a screen resolution item 620 is selected on the display setting screen, the display panel 160 of the electronic device may output a screen resolution setting screen as shown in a state 635. The screen resolution setting screen may include, for example, manual setting items and automatic setting items. The manual setting item may include, for example, at least one item capable of manually setting the resolution of the display panel 160. The screen resolution setting screen may display a currently set manual setting item (e.g., a WQHD item) in relation to the display panel 160 in a distinguishable manner from other items. When an automatic resolution change item 630 is selected on the screen resolution setting screen, the electronic device may automatically perform the resolution setting of the display panel 160. For example, the display driver circuit 200 of the electronic device may determine the screen resolution based on a data packet length of the first line of the screen data received from the processor 140 as described above, and may adjust the resolution of the display panel 160 based on the determined screen resolution.

According to the various embodiments as described above, the display driver circuit 200 according to one embodiment may include the resolution analyzer configured to detect the size of the portion of screen input data received from the processor, and to acquire the setting related to scaling of the screen input data based on the detected size, and the image processor configured to generate screen output data corresponding to the resolution of the display panel based on the acquired setting, and to supply the generated screen output data to the display panel.

According to various embodiments, the resolution analyzer may include the counter for counting (or calculating) the size of the first line data packet of the screen input data, or may include a count function.

According to various embodiments, the display driver circuit may further include the memory (e.g., the second memory 270) accessible by the display driver circuit, wherein the resolution analyzer may be configured to determine the resolution of the screen input data based on the counted size, and to acquire the setting corresponding to the determined resolution from the memory.

According to various embodiments, the display driver circuit may further include at least one of the frame memory into which the screen input data provided from the processor is written, the memory controller configured to perform the reading operation of the frame memory in which the screen input data is written, based on a memory portion of the acquired setting, the compression decoder configured to decode the screen input data, based on a compression portion of the acquired setting, or the scaler configured to scale the screen input data based on a scale portion of the acquired setting.

According to various embodiments, the resolution analyzer may be configured to count the size of the first line data packet of the screen input data, and acquire the setting corresponding to the counted size from the memory accessible by the display driver circuit.

According to various embodiments, the resolution analyzer may be configured to count the size of the first line data packet of the screen input data, and determine the resolution of the screen input data based on the counted size, and acquire the setting corresponding to the determined resolution from the memory accessible by the display driver circuit, and maintain the previous setting when the setting corresponding to the determined resolution is absent.

According to various embodiments, the resolution analyzer may be configured to: upon receiving the change signal corresponding to change in the resolution of the display panel, acquire the setting corresponding to the determined resolution and the change signal from the memory accessible by the display driver circuit.

According to various embodiments, the image processor may be configured to: when the resolution of the screen input data is different from the resolution of the display panel, scale the screen input data to generate the screen output data, or when the resolution of the screen input data is equal to the resolution of the display panel, skip the scaling of the screen input data to generate the screen output data.

According to the above-described various embodiments, a method for controlling scaling of the display according to one embodiment may include detecting, by the display driver circuit, the size of the portion of screen input data received from the processor, acquiring, by the display driver circuit, the setting related to scaling of the screen input data based on the detected size, generating, by the display driver circuit, screen output data corresponding to the resolution of the display panel, based on the acquired setting, and supplying, by the display driver circuit, the generated screen output data to the display panel.

According to various embodiments, the detecting may include counting the size of the first line data packet of the screen input data.

According to various embodiments, the acquiring of the setting may include determining the resolution of the screen input data based on the counted size, and acquiring the setting based on the determined resolution.

According to various embodiments, the acquiring of the setting may include acquiring the setting corresponding to the determined resolution from the memory accessible by the display driver circuit.

According to various embodiments, the acquiring of the setting may include acquiring the setting via calculation of the setting related to the scaling based on the determined resolution.

According to various embodiments, the generating of the screen output data may include at least one of adjusting the setting of the memory controller related to the reading operation of the frame memory in which the screen input data is written, based on a memory portion of the acquired setting, adjusting the setting of the compression decoder for decoding the screen input data, based on a compression portion of the acquired setting, or adjusting the setting of the scaler for scaling the screen input data, based on a scale portion of the acquired setting.

According to various embodiments, the detecting may include counting the size of the first line data packet of the screen input data, wherein the acquiring of the setting may include acquiring the setting corresponding to the counted size from memory accessible by the display driver circuit.

According to various embodiments, the detecting may include counting the size of the first line data packet of the screen input data, and determining the resolution of the screen input data based on the counted size, wherein the acquiring of the setting may include acquiring the setting corresponding to the determined resolution from memory accessible by the display driver circuit, wherein the acquiring of the setting may further include maintaining the previous setting, or receiving the setting from the processor when the setting corresponding to the determined resolution is absent.

According to various embodiments, the method may further include receiving the change signal corresponding to change in the resolution of the display panel, wherein the acquiring of the setting may include acquiring the setting corresponding to the determined resolution and the change signal from the memory accessible by the display driver circuit.

According to various embodiments, the generating of the screen output data may include: when the resolution of the screen input data is different from the resolution of the display panel, scaling the screen input data to generate the screen output data, or when the resolution of the screen input data is equal to the resolution of the display panel, skipping the scaling of the screen input data to generate the screen output data.

According to the above-described various embodiments, the electronic device according to one embodiment may include the display panel, the display driver circuit for driving the display panel, and the processor for supplying screen input data to the display driver circuit, wherein the display driver circuit may include the resolution analyzer configured to detect the size of the portion of the screen input data received from the processor, and to acquire the setting related to scaling of the screen input data based on the detected size, and the image processor configured to generate the screen output data corresponding to the resolution of the display panel based on the acquired setting, and to supply the generated screen output data to the display panel.

According to various embodiments, the display driver circuit (e.g., the resolution analyzer) may be configured to count the size of the first line data packet of the screen input data, determine the resolution of the screen input data corresponding to the counted size, acquire the setting corresponding to the determined resolution from the memory accessible by the display driver circuit, apply the acquired setting to the component of the display driver circuit related to the scaling, and perform the scaling based on the determined resolution and the resolution of the display panel to generate the screen output data.

Figure 7:
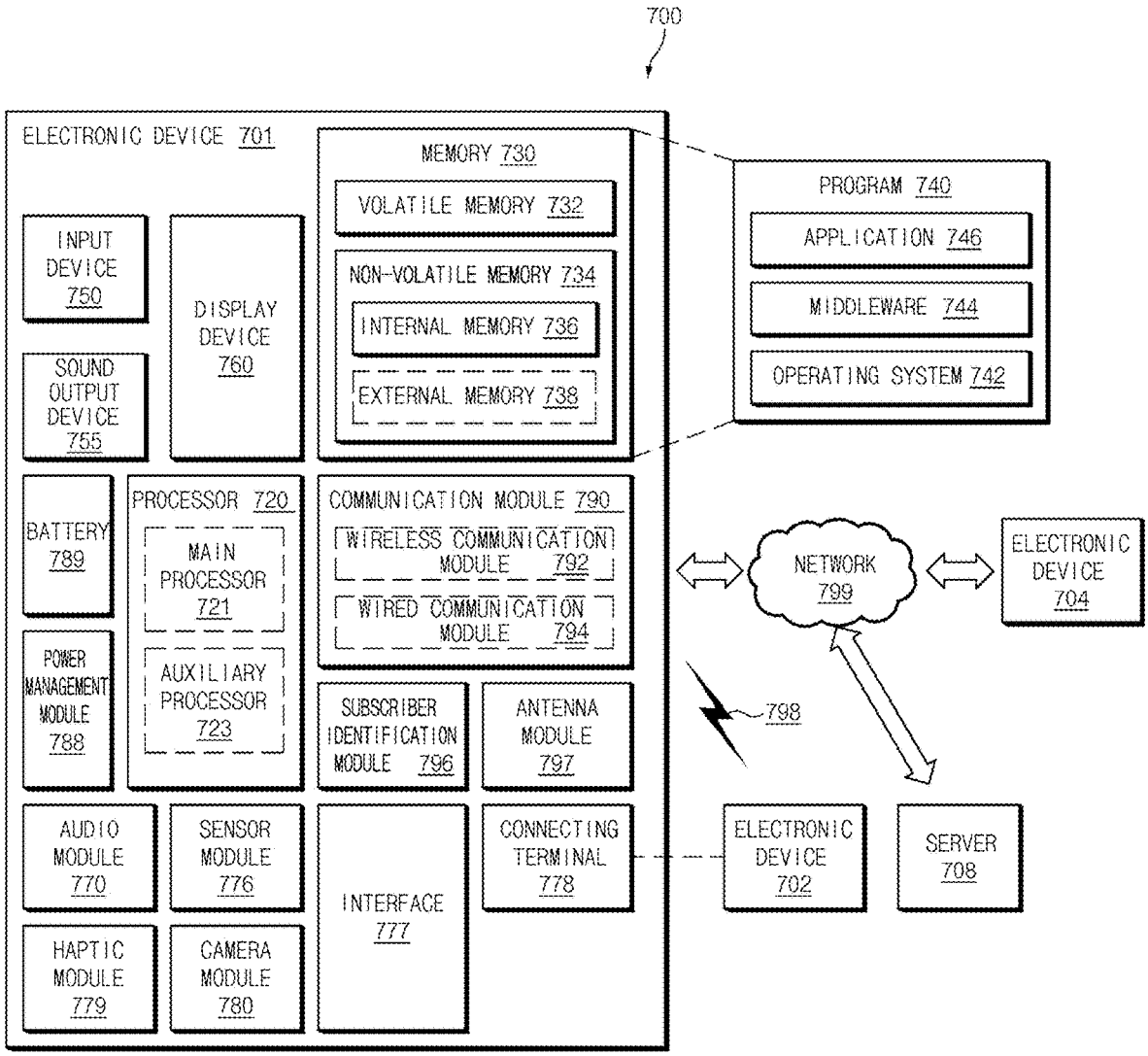
FIG. 7 is a block diagram illustrating an electronic device 701 in a network environment 700 according to various embodiments.

FIG. 7 is a block diagram illustrating an electronic device 701 in a network environment 700 according to various embodiments.

Referring to FIG. 7, the electronic device 701 in the network environment 700 may communicate with an electronic device 702 via a first network 798 (e.g., a short-range wireless communication network), or at least one of an electronic device 704 or a server 708 via a second network 799 (e.g., a long-range wireless communication network). According to an embodiment, the electronic device 701 may communicate with the electronic device 704 via the server 708. According to an embodiment, the electronic device 701 may include a processor 720, memory 730, an input module 750, a sound output module 755, a display module 760, an audio module 770, a sensor module 776, an interface 777, a connecting terminal 778, a haptic module 779, a camera module 780, a power management module 788, a battery 789, a communication module 790, a subscriber identification module (SIM) 796, or an antenna module 797. In some embodiments, at least one of the components (e.g., the connecting terminal 778) may be omitted from the electronic device 701, or one or more other components may be added in the electronic device 701. In some embodiments, some of the components (e.g., the sensor module 776, the camera module 780, or the antenna module 797) may be implemented as a single component (e.g., the display module 760).

The processor 720 may execute, for example, software (e.g., a program 740) to control at least one other component (e.g., a hardware or software component) of the electronic device 701 coupled with the processor 720, and may perform various data processing or computation. According to one embodiment, as at least part of the data processing or computation, the processor 720 may store a command or data received from another component (e.g., the sensor module 776 or the communication module 790) in volatile memory 732, process the command or the data stored in the volatile memory 732, and store resulting data in non-volatile memory 734. According to an embodiment, the processor 720 may include a main processor 721 (e.g., a central processing unit (CPU) or an application processor (AP)), or an auxiliary processor 723 (e.g., a graphics processing unit (GPU), a neural processing unit (NPU), an image signal processor (ISP), a sensor hub processor, or a communication processor (CP)) that is operable independently from, or in conjunction with, the main processor 721. For example, when the electronic device 701 includes the main processor 721 and the auxiliary processor 723, the auxiliary processor 723 may be adapted to consume less power than the main processor 721, or to be specific to a specified function. The auxiliary processor 723 may be implemented as separate from, or as part of the main processor 721.

The auxiliary processor 723 may control at least some of functions or states related to at least one component (e.g., the display module 760, the sensor module 776, or the communication module 790) among the components of the electronic device 701, instead of the main processor 721 while the main processor 721 is in an inactive (e.g., sleep) state, or together with the main processor 721 while the main processor 721 is in an active state (e.g., executing an application). According to an embodiment, the auxiliary processor 723 (e.g., an image signal processor or a communication processor) may be implemented as part of another component (e.g., the camera module 780 or the communication module 790) functionally related to the auxiliary processor 723. According to an embodiment, the auxiliary processor 723 (e.g., the neural processing unit) may include a hardware structure specified for artificial intelligence model processing. An artificial intelligence model may be generated by machine learning. Such learning may be performed, e.g., by the electronic device 701 where the artificial intelligence is performed or via a separate server (e.g., the server 708). Learning algorithms may include, but are not limited to, e.g., supervised learning, unsupervised learning, semi-supervised learning, or reinforcement learning. The artificial intelligence model may include a plurality of artificial neural network layers. The artificial neural network may be a deep neural network (DNN), a convolutional neural network (CNN), a recurrent neural network (RNN), a restricted boltzmann machine (RBM), a deep belief network (DBN), a bidirectional recurrent deep neural network (BRDNN), deep Q-network or a combination of two or more thereof but is not limited thereto. The artificial intelligence model may, additionally or alternatively, include a software structure other than the hardware structure.

The memory 730 may store various data used by at least one component (e.g., the processor 720 or the sensor module 776) of the electronic device 701. The various data may include, for example, software (e.g., the program 740) and input data or output data for a command related thererto. The memory 730 may include the volatile memory 732 or the non-volatile memory 734.

The program 740 may be stored in the memory 730 as software, and may include, for example, an operating system (OS) 742, middleware 744, or an application 746.

The input module 750 may receive a command or data to be used by another component (e.g., the processor 720) of the electronic device 701, from the outside (e.g., a user) of the electronic device 701. The input module 750 may include, for example, a microphone, a mouse, a keyboard, a key (e.g., a button), or a digital pen (e.g., a stylus pen).

The sound output module 755 may output sound signals to the outside of the electronic device 701. The sound output module 755 may include, for example, a speaker or a receiver. The speaker may be used for general purposes, such as playing multimedia or playing record. The receiver may be used for receiving incoming calls. According to an embodiment, the receiver may be implemented as separate from, or as part of the speaker.

The display module 760 may visually provide information to the outside (e.g., a user) of the electronic device 701. The display module 760 may include, for example, a display, a hologram device, or a projector and control circuitry to control a corresponding one of the display, hologram device, and projector. According to an embodiment, the display module 760 may include a touch sensor adapted to detect a touch, or a pressure sensor adapted to measure the intensity of force incurred by the touch.

The audio module 770 may convert a sound into an electrical signal and vice versa. According to an embodiment, the audio module 770 may obtain the sound via the input module 750, or output the sound via the sound output module 755 or a headphone of an external electronic device (e.g., an electronic device 702) directly (e.g., wiredly) or wirelessly coupled with the electronic device 701.

The sensor module 776 may detect an operational state (e.g., power or temperature) of the electronic device 701 or an environmental state (e.g., a state of a user) external to the electronic device 701, and then generate an electrical signal or data value corresponding to the detected state. According to an embodiment, the sensor module 776 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 777 may support one or more specified protocols to be used for the electronic device 701 to be coupled with the external electronic device (e.g., the electronic device 702) directly (e.g., wiredly) or wirelessly. According to an embodiment, the interface 777 may include, for example, a high definition multimedia interface (HDMI), a universal serial bus (USB) interface, a secure digital (SD) card interface, or an audio interface.

A connecting terminal 778 may include a connector via which the electronic device 701 may be physically connected with the external electronic device (e.g., the electronic device 702). According to an embodiment, the connecting terminal 778 may include, for example, a HDMI connector, a USB connector, a SD card connector, or an audio connector (e.g., a headphone connector).

The haptic module 779 may convert an electrical signal into a mechanical stimulus (e.g., a vibration or a movement) or electrical stimulus which may be recognized by a user via his tactile sensation or kinesthetic sensation. According to an embodiment, the haptic module 779 may include, for example, a motor, a piezoelectric element, or an electric stimulator.

The camera module 780 may capture a still image or moving images. According to an embodiment, the camera module 780 may include one or more lenses, image sensors, image signal processors, or flashes.

The power management module 788 may manage power supplied to the electronic device 701. According to one embodiment, the power management module 788 may be implemented as at least part of, for example, a power management integrated circuit (PMIC).

The battery 789 may supply power to at least one component of the electronic device 701. According to an embodiment, the battery 789 may include, for example, a primary cell which is not rechargeable, a secondary cell which is rechargeable, or a fuel cell.

The communication module 790 may support establishing a direct (e.g., wired) communication channel or a wireless communication channel between the electronic device 701 and the external electronic device (e.g., the electronic device 702, the electronic device 704, or the server 708) and performing communication via the established communication channel. The communication module 790 may include one or more communication processors that are operable independently from the processor 720 (e.g., the application processor (AP)) and supports a direct (e.g., wired) communication or a wireless communication. According to an embodiment, the communication module 790 may include a wireless communication module 792 (e.g., a cellular communication module, a short-range wireless communication module, or a global navigation satellite system (GNSS) communication module) or a wired communication module 794 (e.g., a local area network (LAN) communication module or a power line communication (PLC) module). A corresponding one of these communication modules may communicate with the external electronic device via the first network 798 (e.g., a short-range communication network, such as Bluetooth™, wireless-fidelity (Wi-Fi) direct, or infrared data association (IrDA)) or the second network 799 (e.g., a long-range communication network, such as a legacy cellular network, a 5G network, a next-generation communication network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 792 may identify and authenticate the electronic device 701 in a communication network, such as the first network 798 or the second network 799, using subscriber information (e.g., international mobile subscriber identity (IMSI)) stored in the subscriber identification module 796.

The wireless communication module 792 may support a 5G network, after a 4G network, and next-generation communication technology, e.g., new radio (NR) access technology. The NR access technology may support enhanced mobile broadband (eMBB), massive machine type communications (mMTC), or ultra-reliable and low-latency communications (URLLC). The wireless communication module 792 may support a high-frequency band (e.g., the mmWave band) to achieve, e.g., a high data transmission rate. The wireless communication module 792 may support various technologies for securing performance on a high-frequency band, such as, e.g., beamforming, massive multiple-input and multiple-output (massive MIMO), full dimensional MIMO (FD-MIMO), array antenna, analog beam-forming, or large scale antenna. The wireless communication module 792 may support various requirements specified in the electronic device 701, an external electronic device (e.g., the electronic device 704), or a network system (e.g., the second network 799). According to an embodiment, the wireless communication module 792 may support a peak data rate (e.g., 20 Gbps or more) for implementing eMBB, loss coverage (e.g., 764 dB or less) for implementing mMTC, or U-plane latency (e.g., 0.5 ms or less for each of downlink (DL) and uplink (UL), or a round trip of 7 ms or less) for implementing URLLC.

The antenna module 797 may transmit or receive a signal or power to or from the outside (e.g., the external electronic device) of the electronic device 701. According to an embodiment, the antenna module 797 may include an antenna including a radiating element composed of a conductive material or a conductive pattern formed in or on a substrate (e.g., a printed circuit board (PCB)). According to an embodiment, the antenna module 797 may include a plurality of antennas (e.g., array antennas). In such a case, at least one antenna appropriate for a communication scheme used in the communication network, such as the first network 798 or the second network 799, may be selected, for example, by the communication module 790 (e.g., the wireless communication module 792) from the plurality of antennas. The signal or the power may then be transmitted or received between the communication module 790 and the external electronic device via the selected at least one antenna. According to an embodiment, another component (e.g., a radio frequency integrated circuit (RFIC)) other than the radiating element may be additionally formed as part of the antenna module 797.

According to various embodiments, the antenna module 797 may form a mmWave antenna module. According to an embodiment, the mmWave antenna module may include a printed circuit board, a RFIC disposed on a first surface (e.g., the bottom surface) of the printed circuit board, or adjacent to the first surface and capable of supporting a designated high-frequency band (e.g., the mmWave band), and a plurality of antennas (e.g., array antennas) disposed on a second surface (e.g., the top or a side surface) of the printed circuit board, or adjacent to the second surface and capable of transmitting or receiving signals of the designated high-frequency band.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 701 and the external electronic device 704 via the server 708 coupled with the second network 799. Each of the electronic devices 702 or 704 may be a device of a same type as, or a different type, from the electronic device 701. According to an embodiment, all or some of operations to be executed at the electronic device 701 may be executed at one or more of the external electronic devices 702, 704, or 708. For example, if the electronic device 701 should perform a function or a service automatically, or in response to a request from a user or another device, the electronic device 701, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 701. The electronic device 701 may provide the outcome, with or without further processing of the outcome, as at least part of a reply to the request. To that end, a cloud computing, distributed computing, mobile edge computing (MEC), or client-server computing technology may be used, for example. The electronic device 701 may provide ultra low-latency services using, e.g., distributed computing or mobile edge computing. In another embodiment, the external electronic device 704 may include an internet-of-things (IoT) device. The server 708 may be an intelligent server using machine learning and/or a neural network. According to an embodiment, the external electronic device 704 or the server 708 may be included in the second network 799. The electronic device 701 may be applied to intelligent services (e.g., smart home, smart city, smart car, or healthcare) based on 5G communication technology or IoT-related technology.

The electronic device according to various embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that various embodiments of the present disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used in connection with various embodiments of the disclosure, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 740) including one or more instructions that are stored in a storage medium (e.g., internal memory 736 or external memory 738) that is readable by a machine (e.g., the electronic device 701). For example, a processor (e.g., the processor 720) of the machine (e.g., the electronic device 701) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities, and some of the multiple entities may be separately disposed in different components. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

Although the present disclosure has been described with various embodiments, various changes and modifications may be suggested to one skilled in the art. It is intended that the present disclosure encompass such changes and modifications as fall within the scope of the appended claims.

What is claimed is:

1. A display driver circuit comprising:

a resolution analyzer configured to:

detect a size of a portion of screen input data received from a processor, and acquire a setting related to scaling of the screen input data based on the detected size; and an image processor configured to:

generate screen output data corresponding to a resolution of a display panel based on the acquired setting, and supply the generated screen output data to the display panel.

2. The display driver circuit of claim 1, wherein the resolution analyzer includes a counter configured to count a size of a first line data packet of the screen input data.

3. The display driver circuit of claim 2, wherein:

the display driver circuit further comprises a memory accessible by the display driver circuit; and the resolution analyzer is configured to:

determine a resolution of the screen input data based on the counted size, and acquire a setting corresponding to the determined resolution from the memory.

4. The display driver circuit of claim 1, wherein the display driver circuit further comprises:

a frame memory into which the screen input data provided from the processor is written;

a memory controller configured to perform a reading operation of the frame memory in which the screen input data is written based on a memory portion of the acquired setting;

a compression decoder configured to decode the screen input data based on a compression portion of the acquired setting; and a scaler configured to scale the screen input data based on a scale portion of the acquired setting.

5. The display driver circuit of claim 1, wherein the resolution analyzer is configured to:

count a size of a first line data packet of the screen input data, and one of:

acquire the setting corresponding to the counted size from a memory accessible by the display driver circuit, or determine a resolution of the screen input data based on the counted size, acquire the setting corresponding to the determined resolution from the memory accessible by the display driver circuit, and maintain a previous setting when the setting corresponding to the determined resolution is absent.

6. The display driver circuit of claim 1, wherein the resolution analyzer is configured to:

upon receiving a change signal corresponding to change in the resolution of the display panel, acquire a setting corresponding to a determined resolution and the change signal from a memory accessible by the display driver circuit.

7. The display driver circuit of claim 1, wherein the image processor is configured to:

when a resolution of the screen input data is different from the resolution of the display panel, scale the screen input data to generate the screen output data; or when the resolution of the screen input data is equal to the resolution of the display panel, skip the scaling of the screen input data to generate the screen output data.

8. A method for controlling scaling of a display panel, the method comprising:

detecting, by a display driver circuit, a size of a portion of screen input data received from a processor;

acquiring, by the display driver circuit, a setting related to scaling of the screen input data based on the detected size;

generating, by the display driver circuit, screen output data corresponding to a resolution of the display panel based on the acquired setting; and supplying, by the display driver circuit, the generated screen output data to the display panel.

9. The method of claim 8, wherein:

the detecting includes counting a size of a first line data packet of the screen input data, and the acquiring of the setting includes:

determining a resolution of the screen input data based on the counted size; and acquiring the setting based on the determined resolution.

10. The method of claim 9, wherein the acquiring of the setting includes one of:

acquiring the setting corresponding to the determined resolution from a memory accessible by the display driver circuit; and acquiring the setting via calculation of the setting related to the scaling based on the determined resolution.

11. The method of claim 8, wherein the generating of the screen output data includes at least one of:

adjusting a setting of a memory controller related to a reading operation of a frame memory in which the screen input data is written, based on a memory portion of the acquired setting;

adjusting a setting of a compression decoder for decoding the screen input data, based on a compression portion of the acquired setting; and adjusting a setting of a scaler for scaling the screen input data, based on a scale portion of the acquired setting.

12. The method of claim 8, wherein the detecting includes counting a size of a first line data packet of the screen input data, wherein the acquiring of the setting includes acquiring the setting corresponding to the counted size from a memory accessible by the display driver circuit.

13. The method of claim 8, wherein:

the detecting includes:

counting a size of a first line data packet of the screen input data, and determining a resolution of the screen input data based on the counted size, the acquiring of the setting includes acquiring the setting corresponding to the determined resolution from a memory accessible by the display driver circuit, and the acquiring of the setting further includes maintaining a previous setting, or receiving the setting from the processor when the setting corresponding to the determined resolution is absent.

14. The method of claim 8, wherein:

the method further comprises receiving a change signal corresponding to change in the resolution of the display panel, and the acquiring of the setting includes acquiring the setting corresponding to a determined resolution and the change signal from a memory accessible by the display driver circuit.

15. The method of claim 8, wherein the generating of the screen output data includes one of:

when a resolution of the screen input data is different from the resolution of the display panel, scaling the screen input data to generate the screen output data; and when the resolution of the screen input data is equal to the resolution of the display panel, skipping the scaling of the screen input data to generate the screen output data.

* * * * *